US010639901B1

(12) United States Patent
Kawakami et al.

(10) Patent No.: US 10,639,901 B1
(45) Date of Patent: May 5, 2020

(54) MAINTENANCE METHOD OF LIQUID EJECTING APPARATUS

(71) Applicant: SEIKO EPSON CORPORATION, Tokyo (JP)

(72) Inventors: Takayuki Kawakami, Nagano (JP); Toshihiro Shinbara, Nagano (JP); Kazuhiko Hara, Nagano (JP); Kazuyuki Fujioka, Nagano (JP); Takeshi Yoshida, Nagano (JP); Hironori Sato, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/736,298

(22) Filed: Jan. 7, 2020

Related U.S. Application Data

(63) Continuation of application No. 14/794,546, filed on Jul. 8, 2015, now Pat. No. 10,562,309.

(30) Foreign Application Priority Data

Jul. 8, 2014 (JP) ..... 2014-140375
Jul. 11, 2014 (JP) ..... 2014-142945

(51) Int. Cl.
*B41J 2/165* (2006.01)

(52) U.S. Cl.
CPC ..... *B41J 2/16552* (2013.01); *B41J 2/16508* (2013.01); *B41J 2/16538* (2013.01); *B41J 2002/16555* (2013.01)

(58) Field of Classification Search
None
See application file for complete search history.

(56) References Cited

U.S. PATENT DOCUMENTS

| | | | |
|---|---|---|---|
| 5,397,058 | A | 3/1995 | Zanetti |
| 6,168,256 | B1 | 1/2001 | Sharma et al. |
| 6,550,889 | B2 | 4/2003 | Colombat et al. |
| 2002/0036670 | A1 | 3/2002 | Colombat et al. |
| 2003/0122889 | A1 | 7/2003 | Okuda |
| 2004/0036735 | A1 | 2/2004 | Garbacz et al. |
| 2007/0222812 | A1 | 9/2007 | Tokuno et al. |
| 2010/0231634 | A1 | 9/2010 | Yokota et al. |
| 2011/0227998 | A1 | 9/2011 | Kamiyama |
| 2013/0076830 | A1 | 3/2013 | Inoue |
| 2013/0257941 | A1 | 10/2013 | Murata et al. |

FOREIGN PATENT DOCUMENTS

| | | | |
|---|---|---|---|
| CN | 1343565 | A | 4/2002 |
| JP | 05-024185 | A | 2/1993 |
| JP | 2002-019132 | A | 1/2002 |
| JP | 2002-178529 | A | 6/2002 |
| JP | 2005-028758 | A | 2/2005 |
| JP | 2006-281539 | A | 10/2006 |
| JP | 2007-008103 | A | 1/2007 |
| JP | 2008-080180 | A | 4/2008 |
| JP | 2008-194653 | A | 8/2008 |
| JP | 2008-201021 | A | 9/2008 |

(Continued)

*Primary Examiner* — Alejandro Valencia
(74) *Attorney, Agent, or Firm* — Global IP Counselors, LLP

(57) ABSTRACT

A liquid ejecting apparatus includes a liquid ejecting section that is capable of ejecting a first liquid from an opening of a nozzle with respect to media; and a two-fluid ejecting apparatus that is capable of ejecting at least one of a gas and a second liquid with respect to the liquid ejecting section.

9 Claims, 12 Drawing Sheets

(56) References Cited

FOREIGN PATENT DOCUMENTS

| | | | |
|---|---|---|---|
| JP | 2010-214653 | A | 9/2010 |
| JP | 2011-016311 | A | 1/2011 |
| JP | 2011-051281 | A | 3/2011 |
| JP | 2011-189654 | A | 9/2011 |
| JP | 2014-034027 | A | 2/2014 |
| WO | 2008/105280 | A1 | 9/2008 |

MAINTENANCE METHOD OF LIQUID EJECTING APPARATUS

CROSS-REFERENCE TO RELATED APPLICATION

This application is a continuation application of U.S. patent application Ser. No. 14/794,546 filed on Jul. 8, 2015. This application claims priority to Japanese Patent Application No. 2014-140375 filed on Jul. 8, 2014 and Japanese Patent Application No. 2014-142945 filed on Jul. 11, 2014. The entire disclosures of Japanese Patent Application Nos. 2014-140375 and 2014-142945 and U.S. patent application Ser. No. 14/794,546 are hereby incorporated herein by reference.

BACKGROUND

1. Technical Field

The present invention relates a liquid ejecting apparatus of, for example, an ink jet type printer and the like, and a maintenance method of the liquid ejecting apparatus.

2. Related Art

As a type of the liquid ejecting apparatus, an ink jet type print of the related art is known in which ink is ejected from a nozzle of a recording head to media such as paper to thereby perform printing. In such a printer, a so called cleaning is performed in which thickened ink, air bubbles and the like in the internal portion of the nozzle as a cause of the clogging are suctioned and removed, in a case where the nozzle of the ink jet head is clogged.

However, in the printer described above, in a case where the ink, particularly, that is likely to be solidified, is used, even if the cleaning described above is performed, there is a possibility that the clogging of the nozzle is not resolved. Further, in the related art, an ink discharging apparatus (a liquid ejecting apparatus) is proposed, which includes a washing apparatus (a two-fluid ejecting apparatus) in which a detergent is discharged to a nozzle forming area of an ink jet head (a liquid ejecting section) to thereby dissolve and remove a solidified ink with aid of the detergent (for example, JP-A-2002-178529).

However, in the washing apparatus of the ink discharging apparatus of JP-A-2002-178529, the detergent is discharged to the nozzle forming area of the ink jet head to thereby dissolve and remove the solidified ink with aid of the detergent. In other words, the detergent is discharged in the form of a fog to be applied to the nozzle and the peripheral portion of the nozzle, and consequently to cause the detergent to permeates into and dissolve the solidified ink. For this reason, it takes time for the detergent to reach the solidified ink in the internal portion of the nozzle, and thus there is a problem in that it is difficult to efficiently resolve the clogging of the nozzle.

SUMMARY

An advantage of some aspects of the invention is to provide a liquid ejecting apparatus and a maintenance method of a liquid ejecting apparatus in which it is possible to efficiently resolve the clogging of the nozzle of the liquid ejecting section.

Hereinafter, means of the invention and operation effect thereof will be described.

According to an aspect of the invention, there is provided a liquid ejecting apparatus including: a liquid ejecting section that is capable of ejecting a first liquid from an opening of a nozzle with respect to media; and a two-fluid ejecting apparatus that is capable of ejecting at least one of a gas and a second liquid with respect to the liquid ejecting section. The two-fluid ejecting apparatus ejects a mixed fluid in which the second liquid of droplet-like shape including a droplet smaller than the opening of the nozzle of the liquid ejecting section and the gas are mixed, with respect to the liquid ejecting section including the nozzle.

According to the configuration, the droplet of the second liquid in the mixed fluid, the droplet being smaller than the opening of the nozzle of the liquid ejecting section, enters the internal portion of the nozzle through the opening of the nozzle and collides with the clogged portion of the nozzle, and thus it is possible to efficiently resolve the clogging of the nozzle of the liquid ejecting section.

In the liquid ejecting apparatus, it is preferable that a product of a mass of a droplet of the second liquid being smaller than the opening of the nozzle and a square of a flight speed of the droplet at the position of the opening of the nozzle is greater than a product of a mass of droplet of the first liquid ejected from the opening of the nozzle and a square of the flight speed of the droplet.

According to the configuration, with aid of the movement energy generated when the droplet of the second liquid collies with the clogged portion in the internal portion of the nozzle, it is possible to resolve the clogging in the internal portion of the nozzle that cannot be resolved even in a case where the droplet of the first liquid is discharged from the opening of the nozzle.

In the liquid ejecting apparatus, it is preferable that the two-fluid ejecting apparatus ejects the mixed fluid with respect to the liquid ejecting section including the nozzle in a state where the first liquid in the internal portion of the liquid ejecting section is pressurized.

According to the configuration, the mixed fluid that is ejected with respect to the liquid ejecting section including the nozzle and enters the internal portion of the nozzle can be restrained from advancing into the deep side of the internal portion of the liquid ejecting section.

In the liquid ejecting apparatus, it is preferable that the liquid ejecting section includes a pressure chamber that communicates with an internal portion of the nozzle, and an actuator that is capable of pressurizing the internal portion of the pressure chamber, and the two-fluid ejecting apparatus ejects the mixed fluid with respect to the liquid ejecting section including the nozzle in a state where the first liquid in the internal portion of the pressure chamber is pressurized due to a drive of the actuator.

According to the configuration, the first liquid in the internal portion of the pressure chamber is pressurized by a drive of the actuator, and thus, the mixed fluid that is ejected with respect to the liquid ejecting section including the nozzle and enters the internal portion of the nozzle can be restrained from advancing into the deep side of the internal portion of the liquid ejecting section through the pressure chamber.

In the liquid ejecting apparatus, it is preferable that the second liquid is pure water or a liquid in which pure water contains antiseptic.

According to the configuration, the second liquid is the pure water. Therefore, in a case where the second liquid is mixed with the first liquid in the internal portion of the nozzle, it is possible to restrain the second liquid from exerting an adverse effect on the first liquid. Further, since the second liquid is a liquid in which pure water contains an antiseptic, it is possible to suppress decay of the second liquid. For this reason, in a case where the second liquid is mixed with the first liquid in the internal portion of the nozzle, it is possible to restrain the decayed component in the second liquid from exerting an adverse effect on the first liquid.

According to another aspect of the invention, there is provided a maintenance method of a liquid ejecting apparatus which includes a liquid ejecting section that is capable of ejecting a first liquid from an opening of a nozzle with respect to media; and a two-fluid ejecting apparatus that is capable of ejecting at least one of a gas and a second liquid with respect to the liquid ejecting section. Herein, the maintenance method includes, after ejecting a mixed fluid in which the second liquid of droplet-like shape including droplets smaller than the opening of the nozzle of the liquid ejecting section and the gas are mixed, with respect to the liquid ejecting section including the nozzle, discharging the first liquid from the opening of the nozzle.

According to the configuration, the droplet of the second liquid in the mixed fluid, the droplet being smaller than the opening of the nozzle of the liquid ejecting section, enters the internal portion of the nozzle through the opening of the nozzle and collides with the clogged portion of the nozzle, and thus it is possible to efficiently resolve the clogging of the nozzle of the liquid ejecting section. After resolving the clogging of the nozzle of the liquid ejecting section, the first liquid is discharged from the opening of the nozzle. Therefore, it is possible to discharge not only the first liquid but also the mixed fluid remaining in the internal portion of the nozzle.

In the maintenance method of a liquid ejecting apparatus, it is preferable to perform the ejections of the mixed fluid plural times at time intervals.

According to the configuration, the mixed fluid ejected to the liquid ejecting section becomes foam-like. Therefore, even in a case where the opening of the nozzle is clogged, the foam-like mixed fluid clogging the opening of the nozzle during stop of the ejection of the mixed liquid is returned to the droplet-like shape. For this reason, the mixed fluid that is previously ejected to the liquid ejecting section and becomes the foam-like to thereby clog the opening of the nozzle, subsequently can restrain the droplet contained in the mixed fluid ejected to the liquid ejecting section from entering the internal portion of the nozzle.

In the maintenance method of the liquid ejecting apparatus, it is preferable to before performing the ejection of the mixed fluid, eject the second liquid with respect to the liquid ejecting section including the nozzle.

According to the embodiment, previously, the second liquid is ejected with respect to the liquid ejecting section, and subsequently, the gas is mixed with the second liquid to eject the mixed fluid. Therefore, it is possible to suppress a phenomenon where only the gas is ejected with respect to the liquid ejecting section. Accordingly, the gas ejected to the liquid ejecting section can be restrained from advancing into the deep side of the internal portion of the liquid ejecting section from the opening of the nozzle.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, as an example of a liquid ejecting apparatus, one embodiment of an ink jet type printer that ejects ink to thereby print images including characters, drawings and the like will be described with reference to the drawings.

Figure 1:
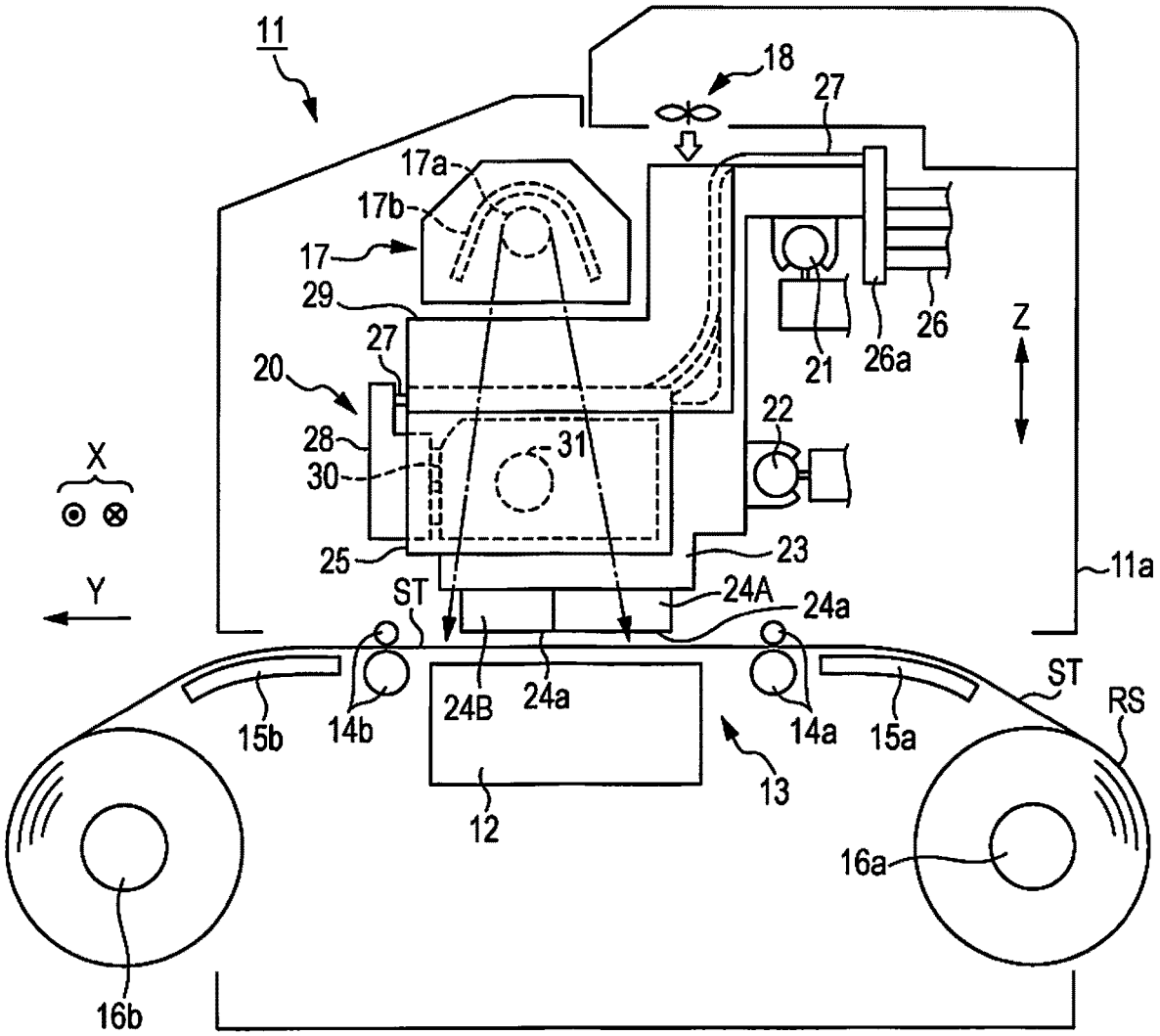
FIG. 1 is a schematic side view showing a printer according to one embodiment.

As showing in FIG. 1, a printer 11 includes a transport section 13 that transports a sheet ST as an example of media supported on a support base 12 along a surface of the support base 12 in the transporting direction Y, a printing section 20 that ejects the ink as an example of the first liquid to the sheet ST which is transported to thereby perform printing on the sheet, and a heating section 17 and a wind blowing section 18 that dry the ink landed on the sheet ST.

The support base 12, the transport section 13, the heating section 17, the wind blowing section 18 and the printing section 20 are assembled in a printer main body 11*a* that is formed of a housing, a frame or the like. The printer 11 is provided with the support base 12 that extends in the width direction of the sheet ST (a direction orthogonal to the drawing surface in FIG. 1).

Figure 9:
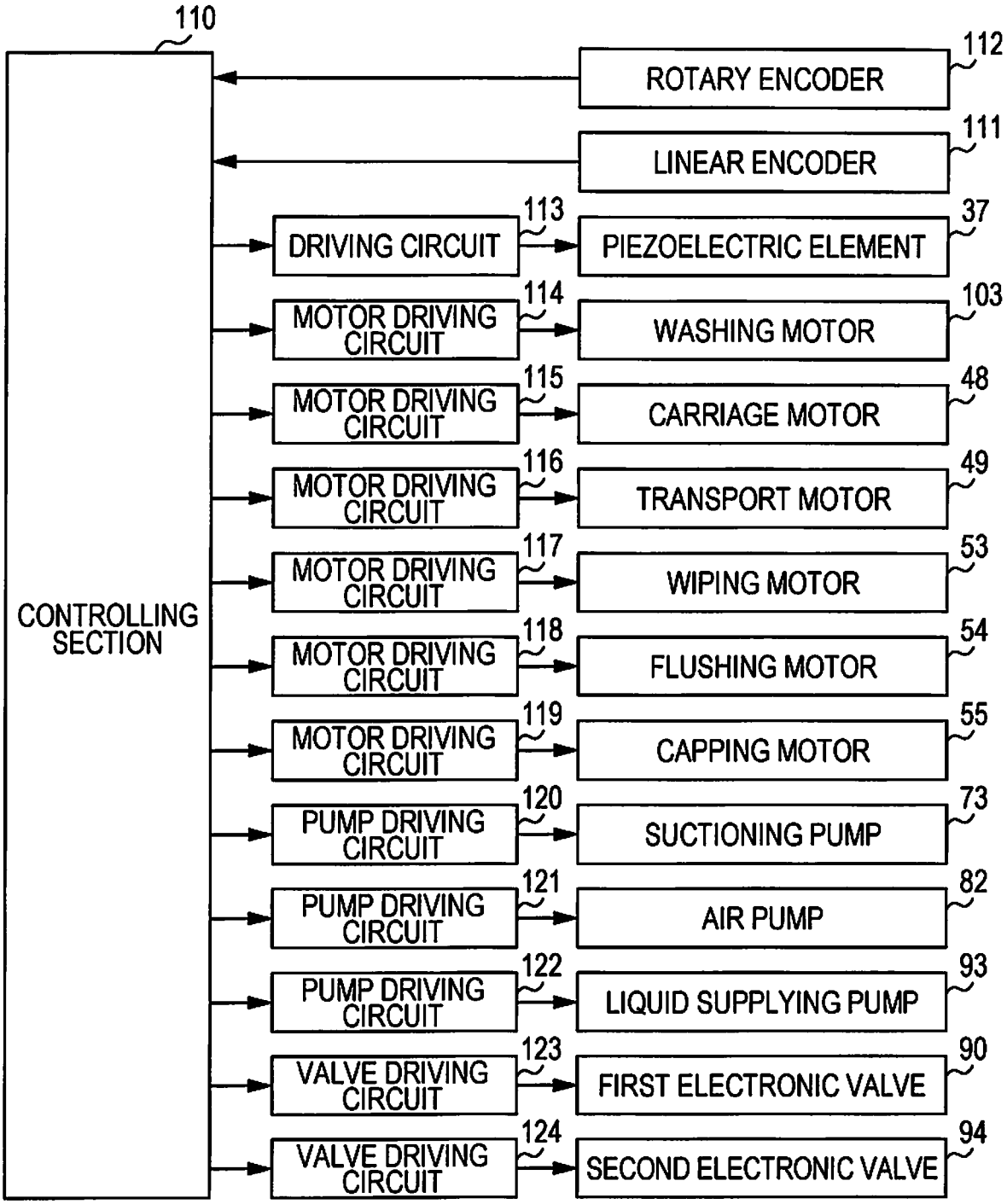
FIG. 9 is a block diagram showing an electrical configuration of a printer.

The transport section 13 includes a transport roller pair 14*a* and a transport roller pair 14*b* that are respectively disposed in the upstream side and the downstream side of the support base 12 in the transporting direction Y and are driven by a transport motor 49 (see FIG. 9). Further, the transport section 13 includes a guide plate 15*a* and a guide plate 15*b* that are respectively disposed in the upstream side and the downstream side of the transport roller pair 14*a* and the transport roller pair 14*b* in the transporting direction Y, and support and guide the sheet ST.

Further, in the transport section 13, the transport roller pairs 14*a* and 14*b* pinch and rotate the sheet ST so that the sheet ST is transported along the surface of the support base 12 and the surface of the guide plates 15*a* and 15*b*. In the embodiment, a roll sheet RS that is wound around a feeding reel 16*a* in a roll-like shape unreels the sheet ST to be continuously transported. Further, the printing section 20 causes ink to be attached, and, as a result, causes an image to be printed on the sheet ST that is unreeled from the roll sheet RS and continuously transported. After this, again the printed sheet ST is wound around a winding reel 16*b* in a roll-like shape.

The printing section 20 includes a carriage 23 that is guided by guide shafts 21 and 22 which extend in the scanning direction X corresponding to the width direction of the sheet ST orthogonal to the transporting direction Y of the sheet ST. The carriage 23 is capable of reciprocally being moved by power of a carriage motor 48 (see FIG. 9) in the scanning direction X. Two liquid ejecting heads 24A and 24B as an example of a liquid ejecting section that ejects ink, a storage section 30 that stores ink which is supplied to liquid ejecting heads 24A and 24B, and a connecting tube 27 that supplies ink to the storage section 30 through a flow path adaptor 28 are mounted in the carriage 23. The storage section 30 is retained in the storage section retaining body 25 mounted in the carriage 23.

Figure 2:
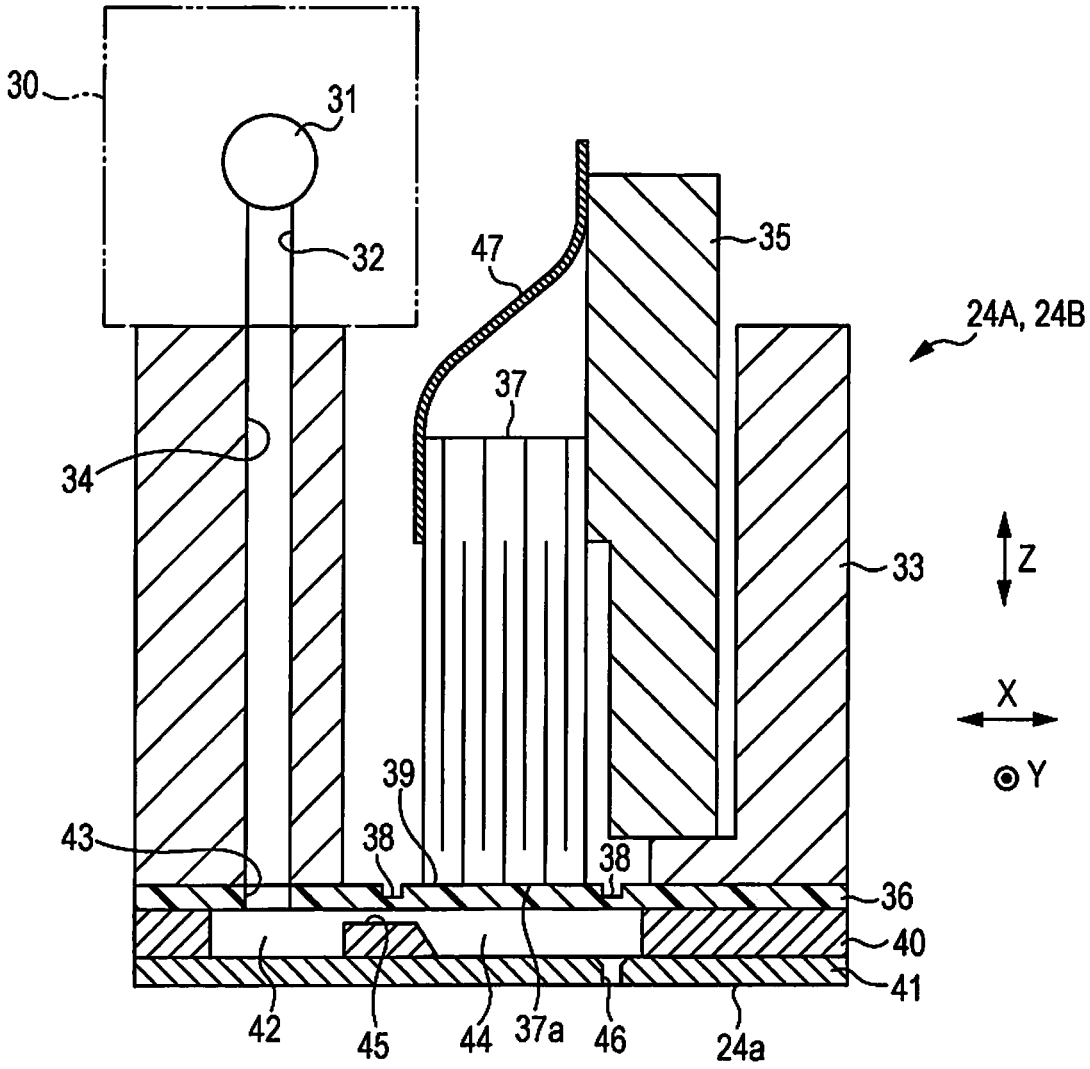
FIG. 2 is a schematic sectional view showing a liquid ejecting head.

As shown in FIG. 1 and FIG. 2, the storage section 30 includes a differential pressure valve 31 that is provided in a midway position of the first ink supplying path 32 through which interior ink is supplied to the liquid ejecting heads 24A and 24B. The differential pressure valve 31 is configured to be opened when ink is ejected (consumed) from the liquid ejecting heads 24A and 24B located in the downstream side of the differential pressure valve 31 and, as a result, the pressure of ink in the downstream side becomes a predetermined negative pressure with respect to the atmospheric pressure, whereas the differential pressure valve 31 is configured to be closed when the opening of the valve causes the ink to be supplied from the storage section 30 to the liquid ejecting heads 24A and 24B and thus the negative pressure of the downstream side is eliminated.

As shown in FIG. 2, the liquid ejecting heads 24A and 24B include a main body case 33 of a tube shape. The second ink supplying path 34 passing through the main body case 33 in the vertical direction is formed in a position in the vicinity of one end portion of the main body case 33 in the scanning direction X, and a fixing plate 35 is erectly provided in a position in the vicinity of the other end portion of the main body case 33 in the scanning direction X. A downstream end of the first ink supplying path 32 connects to an upper stream end of the second ink supplying path 34.

A rectangular and thin plate-like vibration plate 36 having elasticity is fixed to the bottom surface of the main body case 33 so as to cover a lower end opening of the main body case 33 and a lower end opening of the second ink supplying path 34. Further, in the internal portion of the main body case 33, one side surface of the upper end portion in piezoelectric element 37 as an example of an actuator is fixed to the fixing plate 35, and the bottom surface of the piezoelectric element 37 is fixed to the upper surface of the vibration plate 36.

A plurality of cutout grooves (not shown) of the piezoelectric element 37 extending over the entire width of the scanning direction X are provided in the upper side of the piezoelectric element 37 at regular intervals in the transporting direction Y. A depth of each cutout groove (not shown) is set to be a half as large as a height of the piezoelectric element 37 in the vertical direction. A portion interposed between each cutout groove (not shown) in the piezoelectric element 37 corresponds to a piezoelectric element section 37*a*. Grooves 38 are formed in a lattice-like shape in the upper surface of the vibrating plate 36 so as to surround each piezoelectric element section 37*a*, and a mesh portion of the lattice-like groove 38 corresponds to an island section 39.

A flow path forming plate 40 having a rectangular frame-like shape is fixed to the bottom surface of the vibration plate 36 in a tightly contacted state, and a nozzle plate 41 having a rectangular plate-like shape is fixed to the bottom surface of the flow path formed plate 40 in a tightly contacted state. An ink storage chamber 42 is formed in a position in the vicinity of one end portion between the vibration plate 36 and the nozzle plate 41 in the scanning direction X. The ink storage chamber 42 communicates with the second ink supplying path 34 through a communicating hole 43 formed in the vibration plate 36. Further, the ink storage chamber 42 temporarily stores the ink supplied from the storage section 30 through the second ink supplying path 34.

Each pressure chamber 44 corresponding to each piezoelectric element section 37*a* in the vertical direction is respectively formed in a position in the vicinity of the other end portion between the vibration plate 36 and the nozzle plate 41 in the scanning direction X. A communicating path 45 that communicates with the ink storage chamber 42 and each pressure chamber 44 is formed between the ink storage chamber 42 and each pressure chamber 44 which are disposed between the vibration plate 36 and the nozzle plate 41.

Accordingly, the ink temporarily stored in the internal portion of the ink storage chamber 42 is supplied to each pressure chamber 44 through each communicating path 45. Nozzles 46 are provided respectively in positions in the nozzle plate 41 corresponding to the pressure chamber 44, and the bottom surface of the nozzle plate 41 corresponds to the nozzle forming surface 24*a* in which each nozzle 46 is opened. Each nozzle 46 communicates with each pressure chamber 44.

Further, one end portion of a band-like flexible circuit substrate 47 is connected to one side surface in an upper end portion of the piezoelectric element 37 opposite to the fixing plate 35 side, and the other end portion of the flexible circuit substrate 47 is connected to a controlling section 110 (see FIG. 9) to be described later. The piezoelectric element 37 is configured such that a drive signal generated in the controlling section 110 (see FIG. 9) is input to the piezoelectric element 37 through the flexible circuit substrate 47, and thereby each piezoelectric element section 37*a* is capable of individually being moved in the manner of a retractable motion (driven) in the vertical direction.

Further, based on the retractable motion of each piezoelectric element section 37*a*, each island section 39 of the vibration plate 36 vibrates to cause the pressure in the internal portion of the pressure chamber 44 to be changed. The change of pressure in each pressure chamber 44 causes the ink in each pressure chamber 44 to be ejected from the opening of each nozzle 46. Further, as for the configuration of the piezoelectric element 37, a voltage is applied to the piezoelectric element 37 to cause the vibration plate 36 to be elastically deformed and to thereby cause the piezoelectric element section 37*a* to be displaced (contracted) in the direction causing volume of each pressure chamber 44 to be increased. From the state where the piezoelectric element section 37*a* is displaced, the application of the voltage to the piezoelectric element 37 is stopped to cause the vibration plate 36 to be restored to the state prior to the elastic deformation, and thereby it is possible to pressurize each pressure chamber 44.

As shown in FIG. 1 and FIG. 2, the liquid ejecting heads 24A and 24B are attached onto the lower end portion of the carriage 23 in a state where the nozzle forming surface 24*a* and the support base 12 are spaced and face each other at a predetermined interval in the vertical direction Z. On the other hand, the storage section 30 is attached onto an upper side opposite to the liquid ejecting heads 24A and 24B in the vertical direction Z with respect to the carriage 23. Further, an end portion in the downstream side of the connecting tube 27 connects to the flow path adaptor 28 in a position of an upper side higher than the storage section 30.

The upstream side end portion of the connecting tube 27 connects to the downstream side end portion of a plurality of ink supplying tubes 26 that are adaptively deformable with respect to the reciprocally moving carriage 23, through the connecting section 26*a* that is attached onto a part of the carriage 23. Accordingly, for example, the ink accommodated in the ink tank (not shown) is supplied to the storage section 30 through the ink supplying tube 26, the connecting tube 27 and the flow path adapter 28.

The printing section 20 causes ink to be ejected from openings of a plurality of nozzles 46 in the liquid ejecting heads 24A and 24B with respect to the sheet ST on the support base 12 during a process in which the carriage 23 is moved (reciprocal movement) in the scanning direction X. Further, the heating section 17 that heats and dries the ink landed on the sheet ST is provided on an upper position that is spaced from the support base 12 at a predetermined length in the vertical direction Z in the printer 11. Further, the printing section 20 is capable of reciprocally being moved between the heating section 17 and the support base 12 in the scanning direction X.

The heating section 17 includes a heating member 17*a* such as an infrared radiation heater, and a reflecting plate 17*b*. The heating member 17*a* and the reflecting plate 17*b* extend in the scanning direction that is the same as the extending direction of the support base 12. The heating section 17 heats the ink attached onto the sheet ST using a heat (for example, radiant heat) such as an infrared radiation emitted on an area indicated by an arrow mark of a dash dotted line shown in FIG. 1. Further, the wind blowing section 18 that dries the ink attached on the sheet ST using a blowing wind is provided on an upper position in an empted space between the support base 12 and the wind blowing section 18 at an interval between which the printing section 20 is capable of reciprocally being moved in the printer 11.

A heat shielding member 29 that shields heat transfer from the heating section 17 is provided in a position between the storage section 30 and the heating section 17 in the carriage 23. The heat shielding member 29 is formed of, for example, a metallic material such as stainless steel or aluminum having an excellent heat conductivity so as to cover at least an upper surface portion facing the heating section 17 of the storage section 30.

In the printer 11, the storage section 30 is provided for each type of ink. Further, the printer 11 of the embodiment includes the storage section 30 in which coloring ink is stored, and thereby it is possible to perform color printing and monochrome printing. The colors of the coloring ink include, for example, cyan, magenta, yellow, black and white. Each coloring ink includes antiseptic.

For example, in a case where the sheet ST is transparent or semitransparent film, or deep color media, the white ink is used for a substrate printing (solid printing (a printing method of uniformly painting a substrate)) which is performed prior to performing a color printing, or the like. Of course, the used coloring ink may be freely selected, for example, three colors of cyan, magenta and yellow. Further, in addition to these three colors, the coloring ink may additionally include at least one color among, for example, light cyan, light magenta, light yellow, orange, green, grey and the like.

Figure 3:
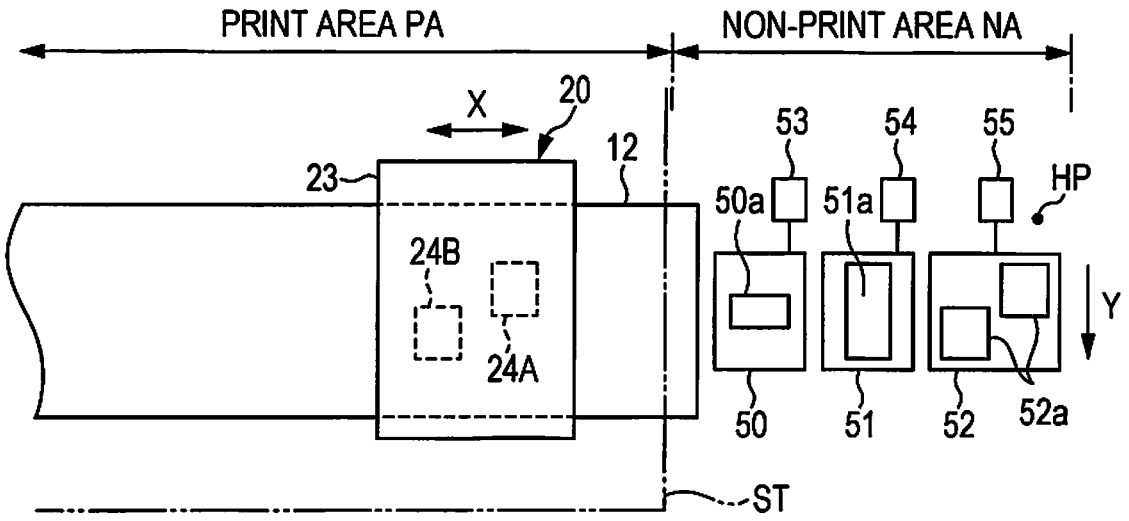
FIG. 3 is a schematic plan view showing a printing section and each unit of a maintenance system disposed in a non-print area.

As shown in FIG. 3, the print area PA corresponds to an area of the maximum width in the scanning direction X in which the ink droplet ejected from the opening of each nozzle 46 (see FIG. 2) of the liquid ejecting heads 24A and 24B can land on the sheet ST of the maximum width transported on the support base 12. In other words, the ink droplet ejected on the sheet ST from the opening of each nozzle 46 (see FIG. 2) of the liquid ejecting heads 24A and 24B lands on the internal portion of the print area PA.

A wiper unit 50, a flushing unit 51 and a cap unit 52 are provided in the non-print area NA in which the liquid eject heads 24A and 24B that is movable in the scanning direction X do not face the sheet ST being transported. Further, in a case where the printing section 20 has a marginless printing function, the print area PA is extended to be slightly wider than a range of the sheet ST being transported of the maximum width in the scanning direction X.

The wiper unit 50 includes a wiper 50*a* that wipes the nozzle forming surface 24*a* (see FIG. 1). The wiper 50*a* of the embodiment is a movable type, and performs wiping operation using power of a wiping motor 53. The flushing unit 51 includes a liquid accommodating section 51*a* that accommodates the ink droplet ejected from the opening of each nozzle 46 (see FIG. 2) of the liquid ejecting head 24A and 24B.

The liquid accommodating section 51*a* of the embodiment is configured to include a belt, and moves the belt using power of the flushing motor 54 during a predetermined time period in which a dirt amount of ink in the belt caused by the flushing is regarded to exceed a regulated amount. Further, the flushing means an operation in which in order to prevent and resolve clogging of the nozzle 46 (see FIG. 2) and the like, ink droplet is forcedly ejected (discharged) from the entire nozzle 46 regardless of printing.

The cap unit 52 includes two cap sections 52*a* that can contact with respect to the nozzle forming surface 24*a* (see FIG. 1) of two liquid ejecting heads 24A and 24B so as to surround the opening of each nozzle 46. The two cap sections 52*a* are configured to be capable of be moved using power of a capping motor 55 between a contacted position with the nozzle forming surface 24*a* and a retracted position spaced apart from the nozzle forming surface 24*a*. Further, positions that are respectively capped by the capping sections 52*a* and correspond to the liquid ejecting heads 24A and 24B are home positions of the liquid ejecting heads 24A and 24B (or the carriage 23).

Figure 4:
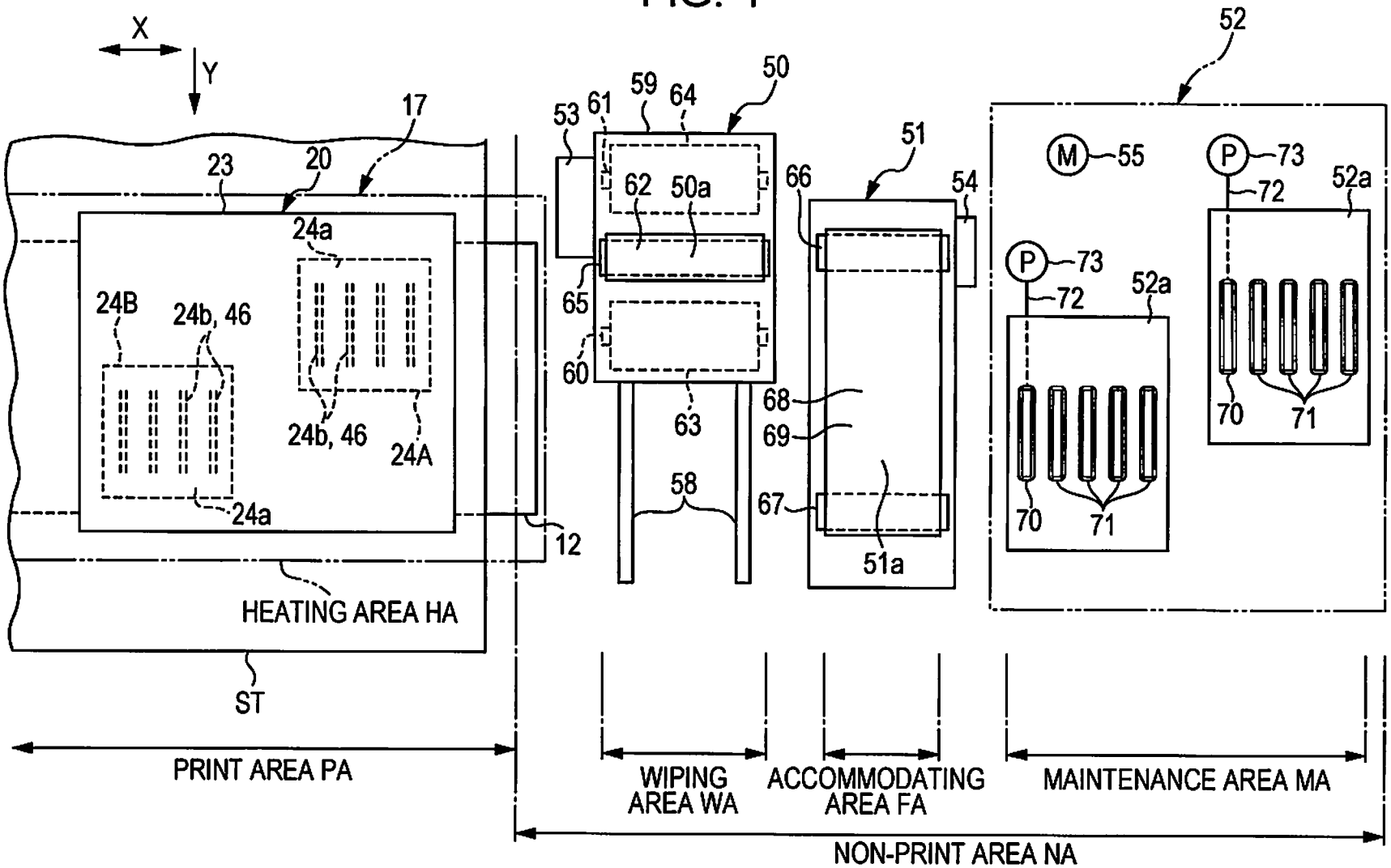
FIG. 4 is a schematic plan view showing a detailed configuration of a printing section and each unit of a maintenance system disposed in a non-print area.

As shown in FIG. 4, the two liquid ejecting heads 24A and 24B attached onto the bottom end portion of the carriage 23 are disposed to be spaced with each other in a predetermined interval in the scanning direction X and to be shifted from each other at a predetermined distance in the transporting direction Y. In the nozzle forming surface 24*a* of the liquid ejecting heads 24A and 24B, nozzle rows of two lines that run closely to each other is formed to be a set, and a total of eight nozzle rows 24*b* corresponding to four sets are arranged at a regular interval in the scanning direction X.

The eight nozzle rows 24*b* formed in the nozzle forming surface 24*a* are configured to include a plurality (for example, 180 pieces) of nozzles 46 which are respectively formed at a constant nozzle pitch in the transporting direction Y. Further, the two liquid ejecting heads 24A and 24B have a positional relationship of the transporting direction Y so that the nozzle pitches between end portions of the nozzles 46 can be identical to each other, when the plurality of nozzles 46 together constituting the nozzle rows 24*b* is projected in the scanning direction X.

The wiper unit 50 includes a movable type housing 59 that is capable of being reciprocally moved using power of the wiping motor 53 on a pair of rails 58 extending in the transporting direction Y. An unreeling shaft 60 and a winding shaft 61 that are located to be spaced apart at a predetermined interval in the wiping direction (which is the same as the transporting direction Y) are rotatably supported, respectively in the internal portion of the housing 59. An unreeling roll 63 around which a before-used cloth sheet 62 is wound is mounted on the unreeling shaft 60, and a winding roll 64 around which an after-used cloth sheet 62 is wound is mounted on the winding shaft 61.

The cloth sheet 62 that is extended between the unreeling roll 63 and the winding roll 64 is wound and extended on an upper surface of a pushing roller 65 which partially protrudes upwardly to be exposed from an opening (not shown) formed on the central portion of the upper surface of the housing 59, and a wiper 50*a* having a semi-circular tube shape (a convex shape) is formed in the portion wound and extended on the pushing roller 65. The wiper 50*a* is upwardly forced.

The housing 59 is configured to include a cassette that accommodates the unreeling roll 63 and the winding roll 64, and a holder that is capable of being guided on the rail 58 and being reciprocally moved using power of the wiping motor 53 through an power transmission mechanism (not shown) (for example, a rack and pinion mechanism) in the wiping direction (which is the same as the transporting direction Y). The wiper motor 53 is driven in the normal and reverse rotations to cause the housing 59 to reciprocally be moved in the transporting direction Y between the retracted position shown in FIG. 4 and a wiping position in which the wiper 50*a* finishes wiping the nozzle forming surface 24*a*.

In this case, when the reciprocal moving of the housing 59 is finished, the power transmission mechanism is switched to a state where the wiping motor 53 and the winding shaft 61 are connected with each other through the power transmission mechanism so as to transfer power between them, and thus a power generated during the reverse rotation of the wiping motor 53 causes the housing 59 to perform a returning operation and causes the cloth sheet 62 to perform a winding operation in which the cloth sheet 62 is wound around the winding roll 64 by a predetermined amount. The two liquid ejecting heads 24A and 24B is sequentially moved to the wiping area WA, and when one of the two liquid ejecting heads 24A and 24B is moved to the wiping area WA, the housing 59 is reciprocally moved one time so as to perform wiping with respect to the nozzle forming surface 24*a* of the moved one of two liquid ejecting heads 24A and 24B, individually.

The flushing unit 51 includes a driving roller 66 and a driven roller 67 that face in parallel to each other in the transporting direction Y, and an endless-like belt 68 wound around and extended between the driving roller 66 and the driven roller 67. The belt 68 has a width greater than or equal to a size of eight rows (a size of 2 rows×4) of the nozzle row 24*b* in the scanning direction X, and constitutes a liquid accommodating section 51*a* that accommodates the ink which is ejected from each nozzle 46 of the liquid ejecting heads 24A and 24B. In this case, the outer peripheral surface of the belt 68 corresponds to a liquid accommodating surface 69 accommodating the ink.

The flushing unit 51 includes a moisturizing liquid supplying unit (not shown) that is disposed on the under bottom of the belt 68 and can supply a moisturizing liquid to the liquid accommodating surface 69, and a scraping unit (not shown) that scrapes waste ink and the like, which is attached on the liquid accommodating surface 69, under wet condition. The waste ink accommodated in the liquid accommodating surface 69 is removed by the scraping unit from the belt 68. For this reason, circumferential movement of the belt 68 causes an accommodating range in the liquid accommodating surface 69 facing the nozzle forming surface 24*a* to be updated.

The cap unit 52 includes two cap sections 52*a* that respectively contact to each nozzle forming surface 24*a* of the two liquid ejecting heads 24A and 24B to be capable of forming a sealed space, respectively. As described above, each cap section 52*a* is moved using power of the capping motor 55 between a contacted position which can contact to the nozzle forming surface 24*a* and a retracted position spaced apart from the nozzle forming surface 24*a*. Each cap section 52*a* includes one suctioning cap 70 and four moisturizing caps 71.

Each moisturizing cap 71 contacts to the nozzle forming surface 24*a* to form a sealed space that surrounds the two-line nozzle row 24*b*, and moisturizes the sealed space. Specifically, dispersion medium or solvent (for example, water and the like) contained in waste ink and the like remaining in the internal portion of the moisturizing cap 71, or ink generated due to evaporation or volatilization of the moisturizing liquid and existing in the internal portion of the nozzle 46 opened to the moisturizing cap 71 is moisturized.

The suctioning cap 70 connects to a suctioning pump 73 through a tube 72. Further, in a state where the suctioning cap 70 contacts to the nozzle forming surface 24*a* to form a sealed space, the suctioning pump 73 is driven to generate a negative pressure in the internal portion of the suctioning cap 70. Therefore, a so called cleaning is performed in which the negative pressure causes thickened ink or air bubbles with ink to be suctioned and discharged from the nozzle 46.

Such a cleaning is performed on the liquid ejecting heads 24A and 24B for each two-line nozzle row 24*b*. After the cleaning is finished, a wiping for removing the ink attached on the nozzle forming surface 24*a* and a flushing for adjusting ink meniscus in the internal portion of the nozzle 46 are sequentially performed.

As shown in FIG. 4, a movement area where the liquid ejecting heads 24A and 24B are movable in the scanning direction X includes a print area PA where ink can be landed from the nozzle 46 of the liquid ejecting heads 24A and 24B when the sheet ST is printed, and a non-print area NA other than the print area PA. The non-print area NA includes a wiping area WA that is provided with the wiper unit 50, an accommodating area FA that is provided with the flushing unit 51, and a maintenance area MA that is provided with the cap unit 52.

In other words, in the non-print area NA, the wiping area WA, the accommodating area FA and the maintenance area MA are disposed in the order of the wiping area WA, the accommodating area FA and the maintenance area MA, starting from the print area PA in the scanning direction X. Further, in an area corresponding to the print area PA in the scanning direction X, a heating area HA is disposed. The heating area HA is provided with the heating section 17 that uses heating to fix the ink landed on the sheet ST.

Figure 5:
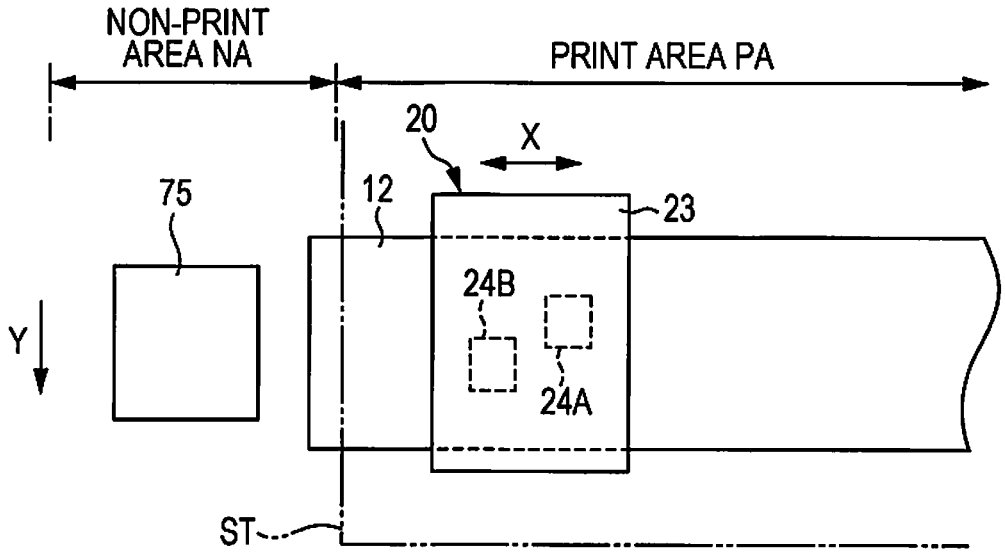
FIG. 5 is a schematic plan view showing a printing section and a two-fluid ejecting apparatus disposed in a non-print area.

As shown in FIG. 3 and FIG. 5, the non-print area NA exists respectively on both sides of print area PA in the scanning direction X. Further, one non-print area NA of two non-print areas NA, located opposite to the home position HP in the scanning direction X, is provided with a two-fluid ejecting apparatus 75 that performs washing on the liquid ejecting heads 24A and 24B.

The two-fluid ejecting apparatus 75 is configured to be capable of ejecting, with respect to the liquid ejecting heads 24A and 24B, at least one of air (gas) and a washing liquid, that is, a liquid (the second liquid) in which pure water contains an antiseptic. Further, the two-fluid ejecting apparatus 75 may eject the air and the washing liquid together, and in this case, it is possible to eject a mixed fluid in which the air and the washing liquid are mixed.

It is preferable that the washing liquid is the same as the main solvent of the ink to be used. In the embodiment, since an aqueous resin ink of which ink solvent is water is used, pure water is used as the washing liquid. However, in a case where the ink solvent is a dissolvent, it is preferable that the same solvent as that of the ink is used as the washing liquid.

Further, it is preferable that the antiseptic contained in the washing liquid is the same as the antiseptic contained in the ink, and such an antiseptic may include, for example, aromatic halide (for example, Preventol, CMK), methylene dithiocyanate, halogen-containing nitrogen sulfur compound, 1,2-benzisothiazoline-3-one (for example, PROXEL, GXL), and the like. As the antiseptic, in a case where PROXEL is used, and in view of difficulty of forming bubbles, it is preferable that the content of PROXEL with respect to the washing liquid is 0.05 or less % by mass.

Figure 6:
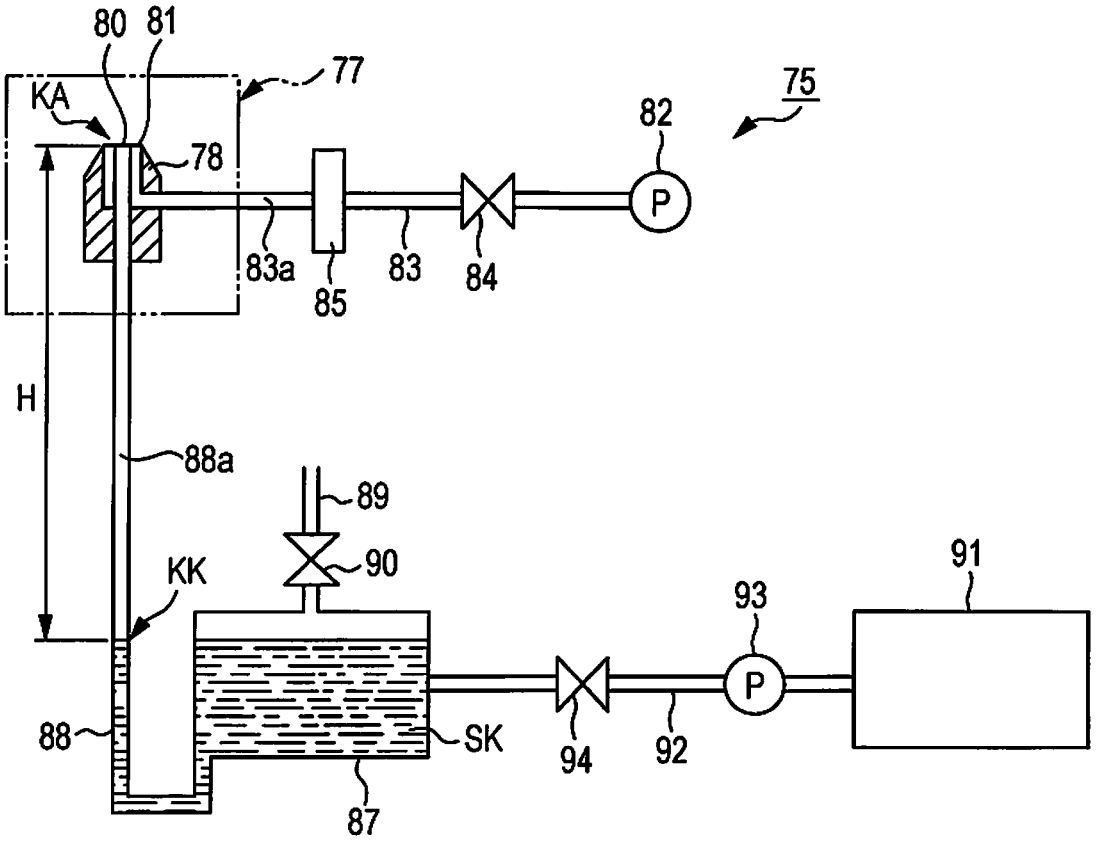
FIG. 6 is a schematic sectional view showing a detailed configuration of the two-fluid ejecting apparatus.

As shown in FIG. 6, the two-fluid ejecting apparatus 75 includes an ejecting unit 77, and the ejecting unit 77 includes a two-fluid ejecting nozzle 78 that is capable of ejecting a mixed fluid. The two-fluid ejecting nozzle 78 is disposed to upwardly eject the mixed fluid. The two-fluid ejecting nozzle 78 includes a liquid ejecting nozzle 80 through which the washing liquid is upwardly ejected, and an annular gas ejecting nozzle 81 through which air is upwardly ejected and which surrounds the liquid ejecting nozzle 80.

In other words, both of the liquid ejecting nozzle 80 and the gas ejecting nozzle 81 are upwardly opened. When it is considered that the ink is attached and solidified, it is preferable that the opening of the liquid ejecting nozzle 80 has a diameter sufficiently larger than that of the opening of the nozzle 46 of the liquid ejecting heads 24A and 24B. For example, it is preferable that the diameter of the opening of the liquid ejecting nozzle 80 is 0.4 mm or greater. In the embodiment, the diameter of the opening of the liquid ejecting nozzle 80 is set to be 1.1 mm.

Further, in the two-fluid ejecting nozzle 78 according to the embodiment, a mixing section KA in which the washing liquid is mixed with the air is used, and the mixing section KA is an so called external mixing type device that is located outside of the two-fluid ejecting nozzle 78. Accordingly, the mixing section KA is configured to include a predetermined space adjacent to the opening of the liquid ejecting nozzle 80 and the opening of the gas ejecting nozzle 81. The two-fluid ejecting nozzle 78 connects to an air supplying pipe 83 that forms a gas flow path 83*a* which supplies air from an air pump 82. The gas flow path 83*a* communicates with the air ejecting nozzle 81.

A pressure adjusting valve 84 that adjusts a pressure in the air supplied from the air pump 82 is provided on a midway position of the air supplying pipe 83. In the two-fluid ejecting apparatus 75 according to the embodiment, the pressure in the air supplied from the air pump 82 to the two-fluid ejecting nozzle 78 is set to be 200 or more kPa. A filter 85 is provided in a position between the pressure adjusting valve 84 and the two-fluid ejecting nozzle 78 in the air supplying pipe 83, and the filter 85 removes dust and the like that exists in the air supplied to the two-fluid ejecting nozzle 78.

Further, the two-fluid ejecting nozzle 78 connects to a liquid supplying pipe 88 that forms a liquid flow path 88*a* which supplies the washing liquid accommodated in a storage tank 87 as an example of the liquid accommodating section. The liquid flow path 88*a* communicates with the liquid ejecting nozzle 80. An atmosphere opening pipe 89 that causes a liquid accommodating space SK in the internal portion of the storage tank 87 to be opened to the atmosphere is provided in the top end portion of the storage tank 87. The atmosphere opening pipe 89 is provided with the first electronic valve 90 as an example of a switching valve.

Accordingly, when the first electronic valve 90 is opened, there appears to be a communication state where the liquid accommodating space SK communicates with the atmosphere through the atmosphere opening pipe 89, whereas when the first electronic valve 90 is closed, there appears to be a non-communication state where the liquid accommodating space SK does not communicate with the atmosphere. In other words, the first electronic valve 90 is configured to perform the opening/closing operation so as to be capable of switching the liquid accommodating space SK between the communication state and the non-communication state.

Further, the storage tank 87 connects to a washing liquid cartridge 91 through a supplying pipe 92, and the washing liquid cartridge 91 accommodates the washing liquid and is detachably mounted on the printer main body 11*a* (see FIG. 1). A liquid supplying pump 93 is provided in a midway position of the supplying pipe 92, and the liquid supplying pump 93 supplies the washing liquid in the internal portion of the washing liquid cartridge 91 to the storage tank 87. The second electronic valve 94 that opens and closes the supplying pipe 92 is provided in a position between the supplying pump 93 in the supplying pipe 92 and the storage tank 87.

Figure 7:
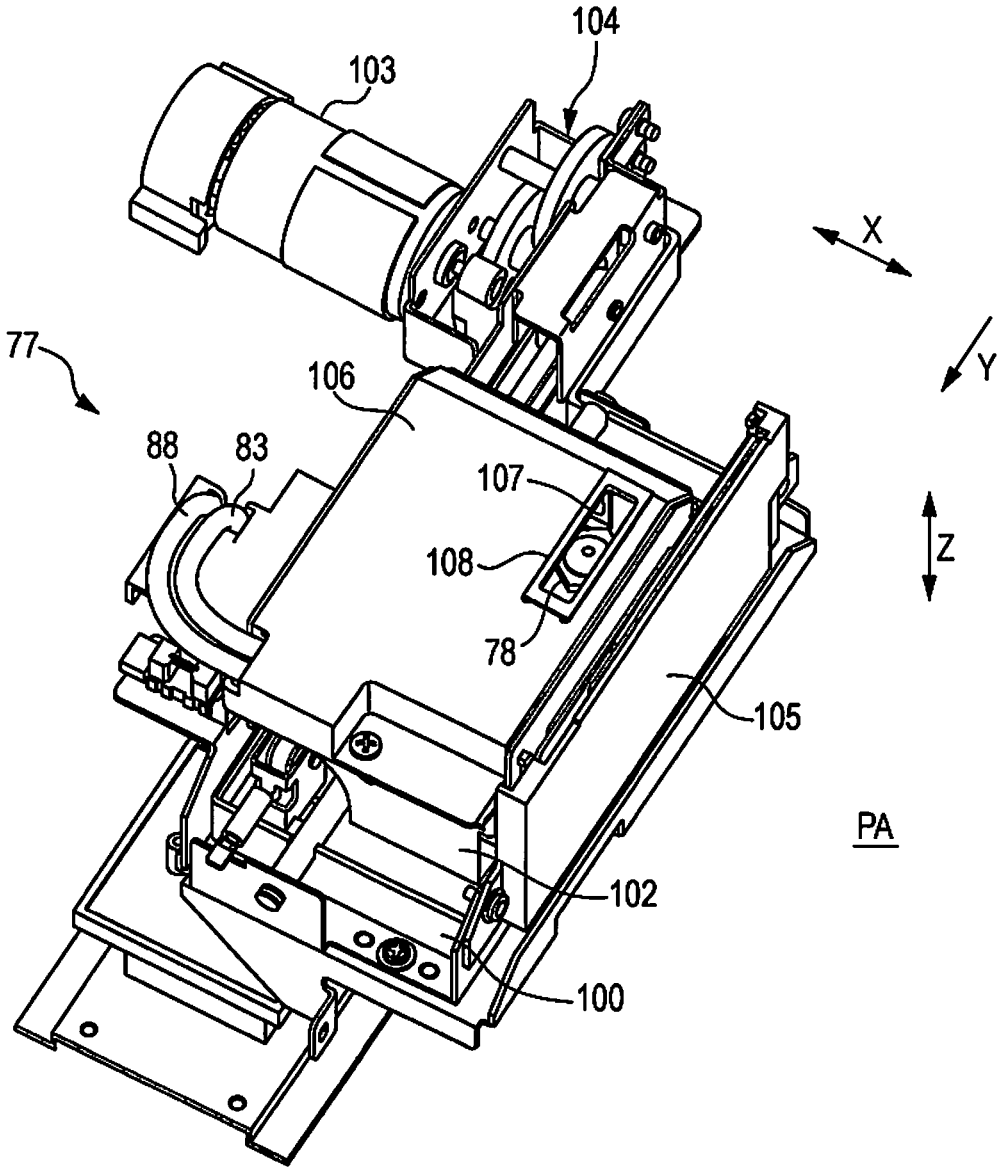
FIG. 7 is a perspective view showing an ejecting unit.
Figure 8:
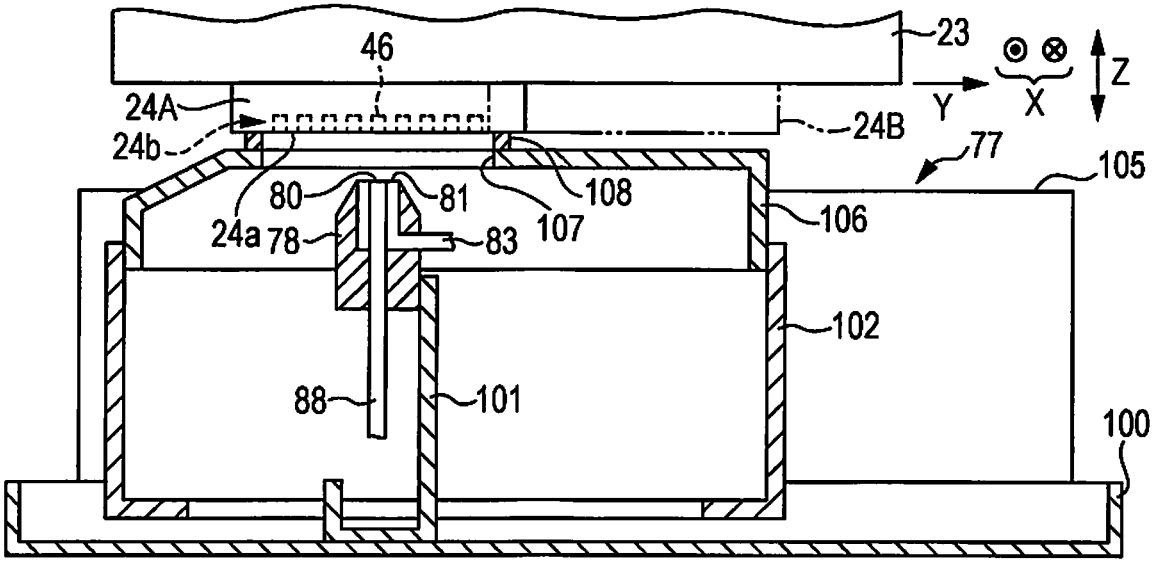
FIG. 8 is a schematic sectional side view showing a usage state of the ejecting unit.

As shown in FIG. 7 and FIG. 8, the ejecting unit 77 includes a base member 100 having an approximately rectangular box-like shape with a bottom, a support member 101 that supports the two-fluid ejecting nozzle 78 disposed in the internal portion of the base member 100 and a rectangular tube-like case 102 that is disposed in the base member 100 and accommodates the two-fluid ejecting nozzle 78 and the support member 101. The two-fluid ejecting nozzle 78 is configured to be secured to the support member 101, and the support member 101 and the case 102 are configured to be capable of individually and reciprocally being moved in the base member 100 in the transporting direction Y.

Further, the ejecting unit 77 includes a washing motor 103, a transmission mechanism 104 that transfers a driving power of the washing motor 103 to the support member 101 and a side plate 105 erectly provided in an end portion of the print area PA. Further, when the driving power of the washing motor 103 is transferred to the support member 101 through the transmission mechanism 104, the support member 101 is reciprocally moved in company with the two-fluid ejecting nozzle 78 in the transporting direction Y. In this case, the case 102 is reciprocally moved in company with the support member 101 in the transporting direction Y in case where the case 102 is pushed by the support member 101 from the internal side of the case 101.

A cover member 106 is attached onto the case 102 and the cover member 106 is an example of a mating member that closes the top end opening of the case 102. A rectangular open hole 107 extending in the transporting direction Y is formed in a position on the top surface of the cover member 106, whose and the position is overlapped with a part of the movement area of the two-fluid ejecting nozzle 78 in the vertical direction Z. A rectangular frame-like lip section 108 surrounding the open hole 107 is provided on the top surface of the cover member 106.

Figure 10:
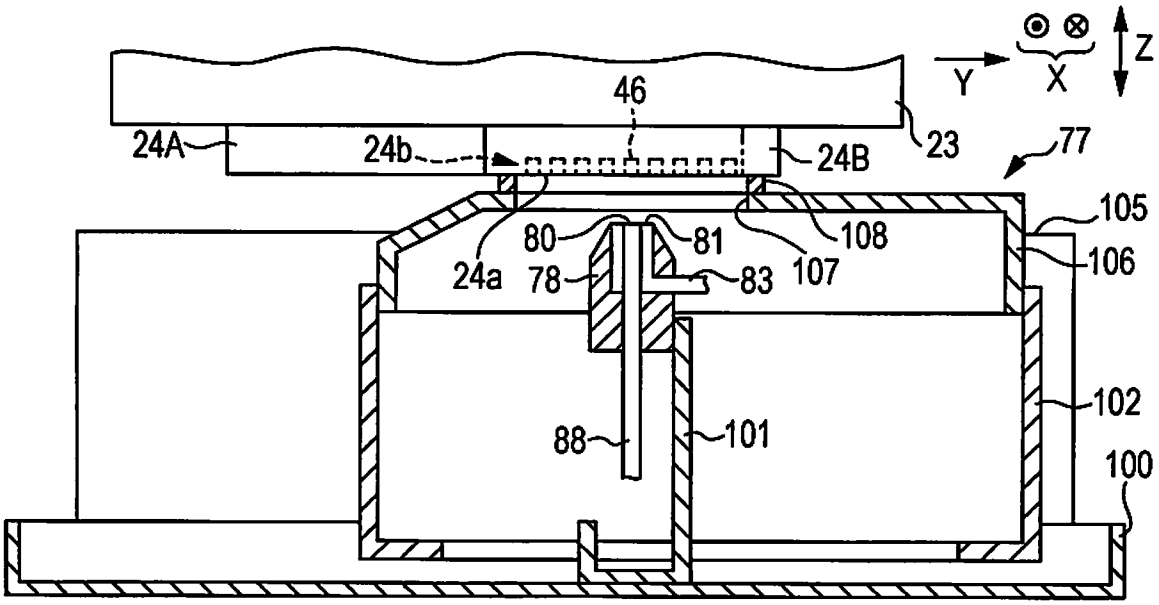
FIG. 10 is a schematic side sectional view showing a usage state of the ejecting unit.

A guide section (not shown) is provided in a side surface of a side plate 105, the side surface facing the case 102, and the guide section guides the case 102 when the case 102 is moved reciprocally in the transporting direction Y. Further, as shown in FIG. 8 and FIG. 10, the guide section (not shown) guides the case 102 such that the case 102 ascends in positions corresponding to the liquid ejecting heads 24A and 24B, respectively, the lip section 108 surrounds the two-line nozzle row 24*b* at a position where the lip section 108 and the two-line nozzle row 24*b* are close to each other, and thus, in this state, the lip section 108 comes in contact with the nozzle forming surface 24*a*.

Further, in the embodiment, a distance between the two-fluid ejecting nozzle 78 and the nozzle forming surface 24*a* in the vertical direction Z is set to be approximately 5 mm, which is greater than a distance (approximately 1 mm) between the sheet ST supported on the support base 12 and the nozzle forming surface 24*a* as shown in FIG. 1.

Hereinafter, an electrical configuration of the printer 11 will be described.

As shown in FIG. 9, the printer 11 includes a controlling section 110 that generally controls the printer 11. The controlling section 110 electrically connects to a linear encoder 111. The linear encoder 111 includes a taper-like code plate that is provided to be extended in the guide shaft 22 in the rear surface side of the carriage 23, and a sensor that detects light transmitted through slits which have a constant pitch and are bored in the code plate secured to the carriage 23 (see FIG. 1).

The controlling section 110 receives from the linear encoder 111, pulses as input pulses of which the number is in proportion to the movement amount of the printing section 20 (see FIG. 1). Thereby, the controlling section 110 adds the number of the input pulses when the printing section 20 is separated from the home position HP (see FIG. 3), and subtracts the number of the input pulses when the printing section 20 comes close to the home position HP so as to figure out a position of the printing section 20 in the scanning direction X.

The controlling section 110 electrically connects to a rotary encoder 112. The rotary encoder 112 includes a disk-like code plate that is attached onto an output shaft of the washing motor 103, and a sensor that detects light transmitted through slits which have a constant pitch and are bored in the code plate.

The controlling section 110 receives from the rotary encoder 112, pulses as input pulses of which the number is in proportion to the movement amount of the support member 101. Thereby, the controlling section 110 adds the number of the input pulses when the support member 101 is separated from a standby position (a position shown in FIG. 11), and subtracts the number of the input pulses when the support member 101 comes close to the standby position so as to figure out a position of the support member 101 (the two-fluid ejecting nozzle 78) in the transporting direction Y.

The controlling section 110 electrically connects to the piezoelectric element 37 through a driving circuit 113, and performs a driving control on the piezoelectric element 37. The controlling section 110 figures out clogging for each nozzle 46 based on a period of residual vibration of each island section 39 in the vibration plate 36, the residual vibration being caused by the drive of the piezoelectric element 37 (each piezoelectric element section 37*a*).

The controlling section 110 electrically connects to the washing motor 103, the carriage motor 48, the transport motor 49, the wiping motor 53, the flushing motor 54, and the capping motor 55 through motor driving circuits 114 to 119, respectively. Further, the controlling section 110 performs driving control on the motors 103, 48, 49, 53, 54 and 55, respectively.

The controlling section 110 electrically connects to the suctioning pump 73, the air pump 82, and the liquid supplying pump 93 through pump driving circuits 120 to 122, respectively. Further, the controlling section 110 performs driving control on the pumps 73, 82 and 93, respectively. The controlling section 110 electrically connects to the first electronic valve 90 and the second electronic valve 94 through valve driving circuits 123 and 124, respectively. Further, the controlling section 110 performs driving control on the electronic valves 90 and 94, respectively.

Hereinafter, the operation of the printer 11 will be described.

When printing data is input to the controlling section 110 from an external device, the controlling section 110 drives the carriage motor 48 based on the printing data to thereby eject ink droplets on the surface of the sheet ST from each nozzle 46 of the liquid ejecting heads 24A and 24B during moving of the printing section 20 in the scanning direction X. If this occurs, the ejected ink droplet lands on the surface of the sheet ST, and thus an image or the like is printed on the surface of the sheet ST.

On the other hand, when the sheet ST is printed, in order to prevent ink from being thickened in the internal portion of the nozzles 46 that do not eject ink droplet among the entire nozzles 46, the printing section 20 is moved to the accommodating area FA and performs the flushing in which the entire nozzles 46 is caused to eject and discharge ink droplet during a predetermined time period (for example, for each lapse of a predetermined time in a range of 10 to 30 seconds).

Further, when a predetermined cleaning condition is satisfied, the controlling section 110 controls the carriage motor 48 to move the printing section 20 to the home position HP, and causes the cleaning to be performed. In the cleaning, the suctioning cap 70 contacts to the nozzle forming surface 24*a* so as to surround the nozzle row 24*b* and thereby form a sealed space. Further, in this state where the sealed space is formed, the suctioning pump 73 is driven to generate a negative pressure in the internal portion of the suctioning cap 70, and thereby to suction a predetermined amount of ink from each nozzle 46 and as a result remove the thickened ink, air bubbles or the like. After the cleaning is finished, the controlling section 110 causes the printing section 20 to be moved to the wiping area WA and causes the wiper 50*a* to wipe the nozzle forming surface 24*a*. Further, the controlling section 110 causes the printing section 20 to be moved to the accommodating area FA and causes the flushing to be performed on the liquid accommodating section 51*a*.

After this, the controlling section 110 detects clogging for each nozzle 46 based on a period of residual vibration of each island section 39 in the vibration plate 36, the residual vibration being caused by the drive of the piezoelectric element 37 (each piezoelectric element section 37*a*). Herein, particularly, in a case where ink to be used includes the resin ink having synthetic resin which is likely to be hardened due to heating, or the UV ink which is likely to be hardened due to emitting of UV (ultraviolet radiation), even if the cleaning is performed on the nozzles, there are still the clogged nozzle 46 in which clogging is still not resolved. For this reason, the detection of clogging for each nozzle 46 is performed even after the cleaning is finished. Further, the clogging, that is referred herein, includes not only a state where the ink in the internal portion of the nozzle 46 is solidified to clog the nozzle, but also a state where the ink in the internal portion of the nozzle 46, in the internal portion of the pressure chamber 44 and in the communicating path 45 is thickened to cause the nozzle 46 not to normally discharge (eject) the ink.

Further, in a case where no clogged nozzle is detected in the entire nozzles 46, when a printing job is a standby state, the controlling section 110 causes the printing section 20 to be moved to the print area PA and perform printing on the sheet ST. On the other hand, when clogged nozzles 46 among the entire nozzles 46 are detected, the controlling section 110 causes the printing section 20 to be moved to the non-print area NA opposite to the home position HP side in the scanning direction X, and causes the two-fluid ejecting apparatus 75 to wash the internal portion of the clogged nozzle 46 to thereby resolve the clogging of the nozzle 46.

Further, in a case where the two-fluid ejecting apparatus 75 is used to wash the internal portion of the clogged nozzle 46, the positional matching between the clogged nozzle 46 and the two-fluid ejecting nozzle 78 are performed so as to face each other in the vertical direction Z. In this case, the positional matching between the clogged nozzle 46 and the two-fluid ejecting nozzle 78 in the scanning direction X (the direction orthogonal to the extending direction of the nozzle row 24*b*) is performed using the moving of the printing section 20, and the positional matching between the clogged nozzle 46 and the two-fluid ejecting nozzle 78 in the transporting direction Y (the extending direction of the nozzle row 24*b*) is performed using the moving of the two-fluid ejecting nozzle 78.

Specifically, in a case where the clogged nozzle 46 is in the liquid ejecting heads 24A, as shown in FIG. 8, after the positional matching of the printing section 20 in the scanning direction X is performed, the case 102 is moved through the support member 101 so that the lip section 108 can contact to the nozzle forming surface 24*a* in a state where the lip section 108 surrounds the nozzle row 24*b* including the clogged nozzle 46. Subsequently, the two-fluid ejecting nozzle 78 is moved through the support member 101 so that the liquid ejecting nozzle 80 of the two-fluid ejecting nozzle 78 can face the clogged nozzle 46, and thus the positional matching of the two-fluid ejecting nozzle 78 in the transporting direction Y is performed.

In this case, in a normal state before a mixed fluid is ejected from the two-fluid ejecting nozzle 78, as shown in FIG. 6, there appears to be a communication state where the first electronic valve 90 is opened and thus the liquid accommodating space SK communicates with the atmosphere and a state where the second electronic valve 94 is closed. In this state, it is preferable that the height H of an air-liquid interface KK of the washing liquid in the liquid flow path 88*a* is set to be—100 mm to—1000 mm when the height of a tip end of the two-fluid ejecting nozzle 78 is assumed to be 0. In the embodiment, the height H is set to be—150 mm when the height of a tip end of the two-fluid ejecting nozzle 78 is assumed to be 0.

Further, as shown in FIG. 6 and FIG. 8, when the air pump 82 is driven to supply air to the two-fluid ejecting nozzle 78, the air is ejected from the gas ejecting nozzle 81. The negative pressure generated due to the ejecting of the air causes the washing liquid in the liquid flow path 88*a* to be suctioned and upwardly lifted, and thereby the washing liquid is ejected from the liquid ejecting nozzle 80. Therefore, the air and the washing liquid are mixed in the mixing section KA to generate the mixed fluid, and thus the mixed fluid is ejected on a partial area of the nozzle forming surface 24*a* including the clogged nozzle 46.

The mixed fluid includes washing the washing liquids of a great number of droplet-like shapes having a diameter of 20 μm or less that is smaller than diameter of the opening of the nozzle 46. In this case, the ejection rate of the mixed fluid from the two-fluid ejecting nozzle 78 is set to be 40 m or more per one second. In this case, it is preferable that the kinetic energy of the ejected washing liquid of droplet-like shape having a diameter of 20 μm or less is equal to or greater than a kinetic energy that can break the film-like ink solidified on the air-liquid interface, the film-like ink being unable to be broken by an energy transferred to the air-liquid interface in the internal portion of the nozzle 46 due to the ink discharging operation or flushing operation during printing.

Accordingly, a product of a mass of a droplet of the washing liquid having a diameter smaller than that of the opening of the nozzle 46 and the square of a flight speed of the droplet at the position of the opening of the nozzle 46 is set to be greater than a product of a mass of an ink droplet ejected from the opening of the nozzle 46 and the square of the flight speed of the ink droplet.

Further, the ejection of the mixed fluid to the clogged nozzle 46 is performed in a state where the ink in the pressure chamber 44 communicating with the clogged nozzle 46 is pressurized by the vibration of the island section 39 of the vibration plate 36, the vibration being caused by the drive of the piezoelectric element section 37*a* corresponding to the pressure chamber 44. Further, when the mixed fluid is ejected to the clogged nozzle 46 from the two-fluid ejecting nozzle 78, the washing liquid of droplet-like shape in the mixed fluid, being smaller than the opening of the nozzle 46, enters the internal portion of the nozzle through the opening of the nozzle 46 and collides with the clogged portion of the nozzle 46.

In other words, the washing liquid of the droplet-like shape having a diameter smaller than that of the opening of the nozzle 46 collides with the ink solidified in the internal portion of the nozzle 46. In this case, the washing liquid generates a shock with respect to the solidified ink, and thus the solidified ink is broken to thereby resolve the clogging of the nozzle 46. In this case, the ink in the internal portion of the pressure chamber 44 communicating with the nozzle 46 of which clogging is resolved is still pressurized. Therefore, the mixed fluid that entered the internal portion of the nozzle 46 can be restrained from advancing into the deep side of the liquid ejecting heads 24A through the pressure chamber 44.

Further, in a case where the ejection of the mixed fluid from the two-fluid ejecting nozzle 78 is stopped, firstly, in a state where the mixed fluid is ejected from the two-fluid ejecting nozzle 78, the first electronic valve 90 is closed to thereby switch the liquid accommodating space SK from a communication state where the liquid accommodating space SK communicates with the atmosphere to a non-communication state where the liquid accommodating space SK does not communicate with the atmosphere. If this occurs, the liquid accommodating space SK is under the negative pressure. Therefore, the negative pressure causes the washing liquid ejected from the liquid ejecting nozzle 80 to be drawn into the liquid flow path 88*a*.

Therefore, the air-liquid interface KK (a water leading surface in the storage tank 87) of the washing liquid in the liquid flow path 88*a* is located at a lower position (the storage tank 87 side) than a position of the mixing section KA. Further, when the air pump 82 is stopped, the air is not ejected from the gas ejecting nozzle 81. In this case, since the air pump 82 is stopped in a state where the air-liquid interface KK of the washing liquid in the liquid flow path 88*a* is located at a lower position than a position of the mixing section KA, the washing liquid in the internal portion of the liquid flow path 88*a* can be restrained from going beyond the mixing section KA and entering the gas ejecting nozzle 81.

Further, in this case, even in a case where the supplying of the air from the air pump 82 to the gas ejecting nozzle 81 through the liquid flow path 88*a* is stopped, the closing state of the first electronic valve 90 is maintained, and the non-communication state of the liquid accommodating space SK is maintained. Further, the unnecessary washing liquid after washing the nozzle 46, the unnecessary ink washed away from the nozzle 46 and the like flow downwardly from the internal portion of the case 102 to the internal portion of the base member 100 and are collected from a waste liquid port (not shown) provided in the base member 100 to a waste liquid tank (not shown).

Further, also in a case where the clogged nozzle 46 is in the liquid ejecting heads 24B, as shown in FIG. 10, similarly to the case of the liquid ejecting heads 24A, the case 102 is moved through the support member 101 so that the lip section 108 can contacts to the nozzle forming surface 24*a* in a state where the lip section 108 surrounds the nozzle row 24*b* including the clogged nozzle 46 of the liquid ejecting heads 24B. Further, similarly to the case of the liquid ejecting heads 24A, in a case where the first electronic valve 90 is closed, the mixed fluid is ejected to the clogged nozzle 46 of the liquid ejecting heads 24B to thereby resolve of the clogging of the nozzle 46.

Figure 11:
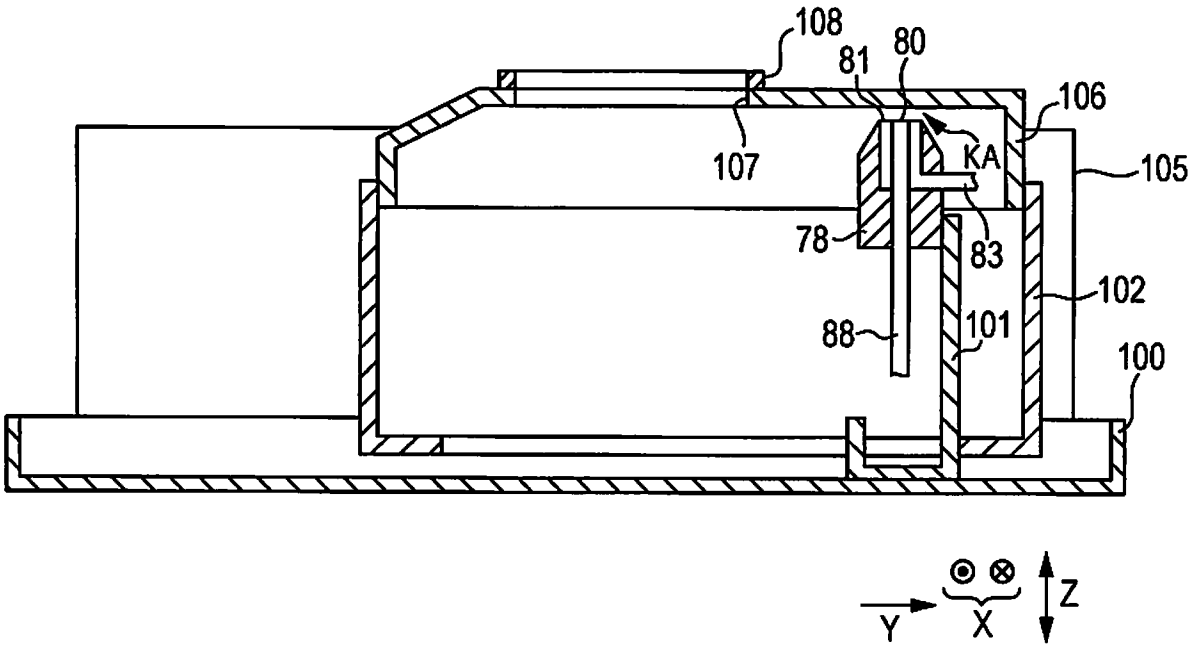
FIG. 11 is a schematic side sectional view showing a standby state of the ejecting unit.

Further, as shown in FIG. 11, after the washing in which the two-fluid ejecting apparatus 75 is used to wash the clogged nozzle 46 of the liquid ejecting heads 24A and 24B is finished, in a state where the mixed fluid is ejected from the two fluid ejecting nozzle 78, the support member 101 is moved to the standby position, and the two-fluid ejecting nozzle 78 faces a position in which the two-fluid ejecting nozzle 78 does not face the open hole 107 on the top wall of the cover member 106. In this case, a small gap is formed between the two-fluid ejecting nozzle 78 and the top wall of the cover member 106.

If this occurs, the air ejected from the annular gas ejecting nozzle 81 surrounding the liquid ejecting nozzle 80 collides with the top wall of the cover member 106 and flows along the top wall so that pressure increases in the internal side of the air ejected from the annular gas ejecting nozzle 81, in other words, the upper side of the liquid ejecting nozzle 80. Further, the increased pressure in the upper side of the liquid ejecting nozzle 80 causes the washing liquid in the internal portion of the liquid flow path 88*a* to be downwardly (to the storage tank 87 side) pushed. In other words, there is a state where air-liquid interface KK of the washing liquid in the liquid flow path 88*a* is slightly pushed downwardly to be in a low position when compared with the case of the mixing section KA.

In this state, when the air pump 82 is stopped, the air is not ejected from the gas ejecting nozzle 81. In this case, since the air pump 82 is stopped in a state where the air-liquid interface KK of the washing liquid in the internal portion of the liquid flow path 88*a* is located at a lower position than a position of the mixing section KA, the washing liquid in the liquid flow path 88*a* can be restrained from going beyond the mixing section KA and entering the gas ejecting nozzle 81.

After that, the printing section 20 is moved to the home position HP side, the cleaning or the flushing in which the ink is discharged from the opening of each nozzle 46 of the liquid ejecting heads 24A and 24B is performed to remove the washing liquid or the air bubbles remaining in the internal portion of the liquid ejecting heads 24A and 24B. Further, in this case, the cleaning or the flushing is weakly performed to the extent that the discharge amount of the ink (the amount of consumption) is small. The reason is that the ejection of the mixed fluid to the clogged nozzle 46 is performed in a state where the ink in the internal portion of the pressure chamber 44 communicating with the clogged nozzle 46 is pressurized as described above, and therefore, the mixed fluid can be restrained from advancing (reversely flowing) into the deep side of the liquid ejecting heads 24A and 24B through the pressure chamber 44.

According to the embodiment described above, the following effect can be obtained.

(1) The two-fluid ejecting apparatus 75 ejects the mixed fluid in which the washing liquid of the droplet-like shape including droplets smaller than the opening of each nozzle of the liquid ejecting heads 24A and 24B and the air are mixed, with respect to the liquid ejecting heads 24A and 24B including the nozzle 46. For this reason, the droplet of the washing liquid in the mixed fluid, the droplet being smaller than the opening of the nozzle 46 of the liquid ejecting heads 24A and 24B, enters the internal portion of the nozzle 46 through the opening of the nozzle 46 and collides with the clogged portion of the nozzle 46, and thus it is possible to efficiently resolve the clogging of the nozzle 46.

(2) When the mixed fluid is ejected from the two-fluid ejecting nozzle 78 to the nozzle 46, a product of a mass of a droplet of the washing liquid that is smaller of the opening of the nozzle 46 and the square of a flight speed of the droplet at the position of the opening of the nozzle 46 is greater than a product of a mass of an ink droplet ejected from the opening of the nozzle 46 and the square of the flight speed of the ink droplet. For this reason, using the movement energy generated when the droplet of the washing liquid collies with the clogged portion in the internal portion of the nozzle 46, it is possible to resolve the clogging in the internal portion of the nozzle 46 that cannot be resolved even in a case where the cleaning or the flushing in which the ink droplet is discharged from the opening of the nozzle 46 is performed.

(3) The ejection of the mixed fluid to the clogged nozzle 46 from the two-fluid ejecting nozzle 78 is performed in a state where the ink in the internal portion of the pressure chamber 44 communicating with the clogged nozzle 46 is pressurized by the vibration of the island section 39 of the vibration plate 36, the vibration being caused by the drive of the piezoelectric element section 37*a* corresponding to the pressure chamber 44. For this reason, the mixed fluid that is rejected with respect to the clogged nozzle 46 and enters the internal portion of the nozzle 46 can be restrained from advancing into the deep side of the internal portion of the liquid ejecting heads 24A and 24B through the pressure chamber 44.

(4) Since the washing liquid corresponds to a liquid in which pure water contains an antiseptic, it is possible to suppress decay of the washing liquid. For this reason, even in a case where the washing liquid is mixed with the ink in the internal portion of the nozzle 46, it is possible to restrain the decayed component in the washing liquid from exerting an adverse effect on the ink.

(5) After the mixed fluid that includes the washing liquid of the droplet-like shape having droplets smaller than the opening of the nozzle 46 is ejected with respect to the clogged nozzle 46 to thereby resolve the clogging of the nozzle 46, the cleaning or the flushing in which the ink is discharged from the opening of the nozzle 46 is performed. For this reason, when the mixed fluid is ejected with respect to the clogged nozzle 46 to thereby finish resolving the clogging of the nozzle 46, it is possible to enter the internal portion of the liquid ejecting heads 24A and 24B from the opening of the nozzle 46 and discharge and remove the mixed fluid.

Modification Example

Figure 12:
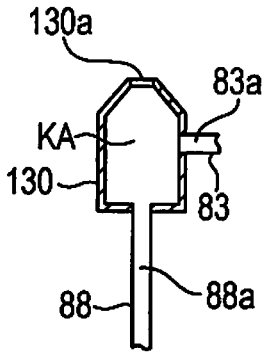
FIG. 12 is a schematic side sectional view showing a two-fluid ejecting nozzle of a modification example.

Further, the embodiment described above may be modified as follows:

As shown in FIG. 12, instead of the external mixing type two-fluid ejecting nozzle 78, a so called internal mixing type two-fluid ejecting nozzle 130 that includes a mixing section KA in the internal portion thereof may be used, and the mixing section KA mixes the washing liquid supplied from the liquid flow path 88*a* and the air supplied from the gas flow path 83*a* to generate the mixed fluid. In this case, the mixed fluid generated in the mixing section KA is ejected from an ejecting port 130*a* provided in the tip end (the upper end) of the two-fluid ejecting nozzle 130.

Figure 13:
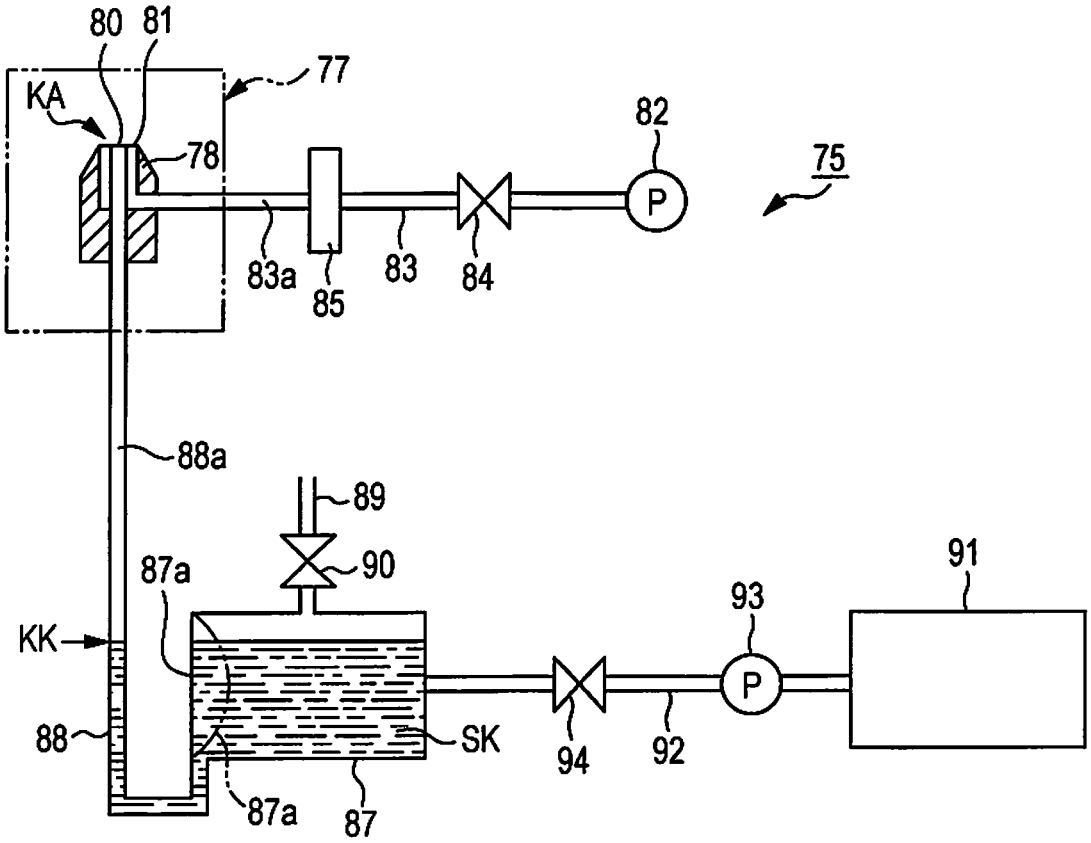
FIG. 13 is a schematic sectional view showing a two-fluid ejecting apparatus of a modification example.

As shown in FIG. 13, in the two-fluid ejecting apparatus 75, at least a part of a wall section 87*a* (or at least one of a plurality of wall sections 87*a*) forming the liquid accommodating space SK that accommodates the washing liquid in the storage tank 87 may be formed of a flexible material. If this occurs, when the mixed fluid is ejected from the two-fluid ejecting nozzle 78, a negative pressure is generated in the liquid accommodating space SK. Therefore, as shown with two point chain line in the drawing, the flexible wall section 87*a* is elastically deformed in the direction of decreasing volume of the liquid accommodating space SK. Further, when the ejection of the mixed fluid from the two-fluid ejecting nozzle 78 is stopped, as shown with the solid line in the drawing, the flexible wall section 87*a* uses self-elastic restoring force to return to the original shape before the elastic deformation. Therefore, the volume of the liquid accommodating space SK also returns to the original state and thus the native pressure is generated in the liquid accommodating space SK. Accordingly, with the simple configuration, it is possible to exert the negative pressure to the liquid accommodating space SK of the storage tank 87 in a state where the ejection of the mixed fluid from the two-fluid ejecting nozzle 78 is not performed.

Figure 14:
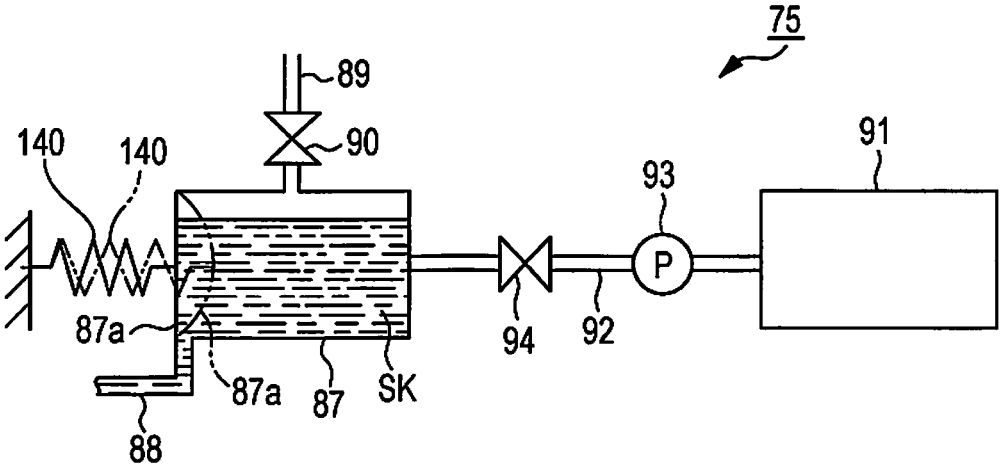
FIG. 14 is a schematic sectional view showing a two-fluid ejecting apparatus of a modification example.

As shown in FIG. 14, in the two-fluid ejecting apparatus 75 of FIG. 13, a spring 140 as an example of a force exerting member may be used to exert a force to the flexible wall section 87*a* of the storage tank 87 in the direction causing the volume of the liquid accommodating space SK to be increased. If this occurs, when the mixed fluid is ejected from the two-fluid ejecting nozzle 78, a negative pressure is generated in the liquid accommodating space SK. Therefore, while opposing resistance to the elastic restoring force of the flexible wall section 87*a* and the energizing force of the spring 140, as shown with two point chain line in FIG. 14, the flexible wall section 87*a* is elastically deformed in the direction of decreasing the volume of the liquid accommodating space SK. Further, when the ejection of the mixed fluid from the two-fluid ejecting nozzle 78 is stopped, the elastic restoring force of the flexible wall section 87*a* and the energizing force of the spring 140 causes the flexible wall section 87*a* to be elastically deformed in the direction causing the volume of the liquid accommodating space SK to be increased. Therefore, the native pressure is generated in the liquid accommodating space SK. For this reason, it is possible to set the energizing force of the spring 140, and thereby set the negative pressure generated in the liquid accommodating space SK. In other words, it is possible to change the energizing force of the spring 140 and thereby change the negative pressure generated in the liquid accommodating space SK.

Instead of the cover member 106, a part of the carriage 23 or an area in which the nozzle 46 does not exist in the nozzle forming surface 24*a* may be used as a mating member that correspondingly faces the two-fluid ejecting nozzle 78 in a state where the mixed fluid is not ejected from the two-fluid ejecting nozzle 78.

The two-fluid ejecting nozzle 78 may be disposed such that the mixed fluid is ejected in the horizontal direction or an inclined direction.

A pressurizing pump that supplies the ink in the internal portion of the ink tank (not shown) to the storage section 30 may be provided, and in a state where the differential pressure valve 31 is opened, the pressurizing pump may be used to pressurize the ink in the pressure chamber 44 communicating with the clogged nozzle 46 during the ejection of the mixed fluid to the clogged nozzle 46 from the two-fluid ejecting nozzle 78.

The ejection of the mixed fluid to the liquid ejecting heads 24A and 24B including the clogged nozzle 46 from the two-fluid ejecting nozzle 78 may be performed plural times at time intervals. In this case, the time interval may be constant or not constant. If this occurs, the mixed fluid ejected to the liquid ejecting heads 24A and 24B becomes foam-like. Therefore, even in a case where the opening of the nozzle 46 is clogged, the foam-like mixed fluid clogging the opening of the nozzle 46 during stop of the ejection of the mixed liquid is returned to the droplet-like shape. For this reason, the mixed fluid that is previously ejected to the liquid ejecting heads 24A and 24B and becomes the foam-like to thereby clog the opening of the nozzle 46, subsequently can restrain the droplet contained in the ejected mixed fluid to the liquid ejecting heads 24A and 24B from entering the internal portion of the nozzle 46.

Before the ejection of the mixed fluid to the liquid ejecting heads 24A and 24B including the nozzle 46 from the two-fluid ejecting nozzle 78 is performed, the washing liquid may be ejected with respect to the liquid ejecting heads 24A and 24B including the nozzle 46. In this case, the liquid supplying pump 93 may be used for the ejection of the washing liquid from the liquid ejecting nozzle 80. However, it is preferable that a pump which ejects the washing liquid from the liquid ejecting nozzle 80 is separately provided in the midway position of the liquid supplying pipe 88. If this occurs, previously, the washing liquid is ejected with respect to the liquid ejecting heads 24A and 24B including the nozzle 46, and subsequently, the air is mixed with the washing liquid to eject the mixed fluid. Therefore, it is possible to restrain only the air from being ejected with respect to the liquid ejecting heads 24A and 24B including the nozzle 46. Accordingly, the air ejected to the liquid ejecting heads 24A and 24B including the nozzle 46 can be restrained from advancing into the deep side of the internal portion of the liquid ejecting heads 24A and 24B from the opening of the nozzle 46. Further, in this case, even in a case where the ejection of the mixed fluid to the liquid ejecting heads 24A and 24B including the nozzle 46 is stopped, previously, the ejection of the air is stopped, and subsequently, the ejection of the washing liquid is stopped. Therefore, it is possible to restrain only the air from being ejected with respect to the liquid ejecting heads 24A and 24B including the nozzle 46.

Before the ejection of the mixed fluid to the liquid ejecting heads 24A and 24B including the nozzle 46 from the two-fluid ejecting nozzle 78 is performed, the washing liquid may be ejected with respect to an area of the liquid ejecting heads 24A and 24B in which the nozzle 46 is not included. Further, before the ejection of the mixed fluid to the liquid ejecting heads 24A and 24B including the nozzle 46 from the two-fluid ejecting nozzle 78 is performed, the washing liquid may be ejected to a position in which the two-fluid ejecting nozzle 78 does not face the liquid ejecting heads 24A and 24B. Even If this occurs, it is possible to restrain only the air from being ejected with respect to the liquid ejecting heads 24A and 24B including the nozzle 46.

The washing liquid as the second liquid may be configured to include only the pure water (the pure water that does not include an antiseptic). If this occurs, in a case where the washing liquid is mixed with the ink in the internal portion of the nozzle 46, it is possible to restrain the washing liquid from exerting an adverse effect on the ink.

In a case where the mixed fluid is ejected to the clogged nozzle 46, the piezoelectric element section 37*a* correlating with the clogged nozzle 46 may be driven to be the same case as that of the ink discharging time during printing or the flushing time. Even If this occurs, it is possible to restrain the mixed fluid from entering the internal portion of the clogged nozzle 46.

In a case where the mixed fluid is ejected to the clogged nozzle 46, the piezoelectric element section 37*a* correlating with the nozzle 46 other than the clogged nozzle 46 may be driven to respectively pressurize the pressure chamber 44 correlating with the nozzle 46 other than the clogged nozzle 46. If this occurs, it is possible to restrain the mixed fluid from entering the internal portion of the nozzle 46 other than the clogged nozzle 46.

The two-fluid ejecting apparatus 75 may be disposed in the home position HP side.

A wiper that wipes the nozzle forming surface 24*a* of the liquid ejecting heads 24A and 24B may be separately provided between the two-fluid ejecting apparatus 75 and the print area PA in the non-print area NA. If this occurs, after the two-fluid ejecting apparatus 75 ejects the mixed fluid to the liquid ejecting heads 24A and 24B, it is possible for the wiper describe above to wipe the nozzle forming surface 24*a* wetted with the mixed fluid (the washing liquid) before the printing section 20 is crossed over the print area PA and moved to the home position HP side. Accordingly, it is possible to restrain the mixed fluid (the washing liquid) attached on the nozzle forming surface 24*a* from appearing during the moving of the printing section 20 in the print area PA.

Instead of the air pump 82, an air compressor of equipment in a factory may be used. In this case, a three-way valve that causes the gas flow path 83*a* to be opened to the atmosphere may be provided in a position between the pressure adjusting valve 84 and the filter 85 in the air supplying pipe 83 to thereby cause the gas flow path 83*a* to be opened to the atmosphere during non-use of the two-fluid ejecting apparatus 75.

In a case where the controlling section 110 detects the nozzle 46 of which clogging is not resolved even if a predetermined times of the cleaning are performed according to the detection history of the clogging, a so called supplementary printing may be performed in which the nozzle 46 of which clogging is not resolved is not temporarily used, and the other normal nozzle 46 is used instead to eject the ink and perform printing. In this case, after the supplementary printing, the two-fluid ejecting apparatus 75 may be used to wash the nozzle 46 of which clogging is not resolved even if a predetermined times of the cleaning are performed, and thus the clogging of the nozzle may be eventually resolved.

The nozzle row 24*b* (the nozzle 46) that ejects the ink of the much less frequently used color (kinds) may not be subjected to the ordinary maintenance (the cleaning, the flushing, the wiping and the like), but subjected to the washing using the two-fluid ejecting apparatus 75 so as to resolve the clogging when being able to be used. If this occurs, it is possible to reduce the consumption amount of the ink of the much less frequently used color in the cleaning and or the flushing, and to thereby save the ink.

During the ejection of the mixed fluid to the clogged nozzle 46 from the two-fluid ejecting nozzle 78, it is not always necessary to pressurize the pressure chamber 44 communicating with the clogged nozzle 46.

A product of a mass of a droplet of the washing liquid having a diameter smaller than that of the opening of the nozzle 46 and the square of a flight speed of the droplet at the position of the opening of the nozzle 46 is not necessarily greater than a product of a mass of an ink droplet ejected from the opening of the nozzle 46 and the square of the flight speed of the ink droplet.

In the embodiment described above, the liquid ejecting apparatus may eject or discharge a liquid other than the ink. Further, types of the liquid discharged from the liquid ejecting apparatus in the form of small amounts of droplets may also include granular shape, a tear shape, and a shape having a tail trail like a thread. Further, the liquid referred herein may be any material as long as the material can be ejected from the liquid ejecting apparatus. For example, the materials may includes fluid-like body such as a material having a state of liquid phase, a liquid phase body having a high or low viscosity, sol or gel water, other inorganic solvents, organic solvents, solutions, a liquid phase resin, and a liquid phase metal (a molten metallic liquid). Further, such materials may include not only a liquid as a state of the material, but also something in which particles of a functional material formed of solid material such as pigment or metallic particles are resolved, dispersed or mixed in a solvent, and the like. A typical example of the liquid may include the ink, the liquid crystal and the like as described in the above embodiment. Herein, the inks may include aqueous ink, oily ink, things containing various liquid phase compositions such as gel ink, hot melt ink, and the like. A specific example of the liquid ejecting apparatus may include a liquid ejecting apparatus that ejects a liquid containing material such as electrode material or coloring material of the dissolved or dispersed form that is used for manufacturing, for example, a liquid crystal display, an electroluminescence (EL) display, a surface light emitting display, a color filter and the like. Further, the specific examples may include a liquid ejecting apparatus that ejects a living body organic matter used for manufacturing a biochip, a liquid ejecting apparatus that ejects a liquid corresponding to a test material used as a precision pipette, a printing machine, a microdispenser and the like. Further, the specific examples may include a liquid ejecting apparatus that ejects a lubricant using a pinpoint in a precision machine such as a watch and a camera, and a liquid ejecting apparatus that ejects, on a substrate, a transparent resin liquid such as an ultraviolet curing resin for forming a microhemisphere lens (optical lens) and the like used for an optical communication element. Further, the specific example may include a liquid ejecting apparatus that ejects an etching liquid having an acid, an alkali or the like for etching a substrate and the like.

Hereinafter, the ink (coloring ink) as the first liquid will be described in detail below.

The ink used in the printer 11 contains a resin in terms of composition, and does not substantially contain glycerin having a boiling point of 290° C. under 1 atmosphere. When the ink substantially includes the glycerin, the drying property of the ink is significantly degraded. As a result, in the various types of media, particularly, in the media having non-absorbency of ink or low absorbency of ink, not only is image gradation unevenness exposed to view, but also ink fixability cannot be obtained. Further, it is preferable that the ink substantially does not contain alkylpolyol group (except for the glycerin described above) having a boiling point of 280° C. or more under 1 atmosphere or the equivalent thereof.

Herein, "substantially do not contain" in the specification means not containing more than an amount of an additive that causes sufficient effect to be exerted. If this is expressed in terms of quantization, with respect to the total mass (100 mass %) of the ink, the glycerin is contained not to be, preferably, 1.0 or more mass %, more preferably, 0.5 or more mass %, more preferably, 0.1 or more mass % still more preferably 0.05 or more mass %, and still further more preferably, 0.01 or more mass %. Further, it is most preferable not to contain glycerin of 0.001 or more mass %.

Hereinafter, the additives (components) that are contained or can be contained in the ink described above will be described.

1. Color Materials

The ink may also contain a color material. The color material described above is selected from pigments and dyes.

1-1. Pigments

As a pigment is used as the color material, it is possible to improve the lightfast of the ink. It is possible to use any one of an inorganic pigment or an organic pigment as a pigment. The inorganic pigment is not particularly limited, but may include, for example, carbon black, iron oxide, titanium oxide and oxidation silica.

The organic pigment is not particularly limited, but may include, for example, a quinacridone based pigment, a quinacridone quinone based pigment, a dioxazine based pigment, a phthalocyanine based pigment, an anthrapyrimidine based pigment, an anthranthrone based pigment, an indanthrone based pigment, a flavanthrone based pigment, a perylene based pigment, a diketo pyrrolo pyrrole based pigment, a perinone based pigment, a quinophthalone based pigment, an anthraquinone based pigment, a thioindigo based pigment, a benzimidazolone based pigment, an isoindolinone based pigment, an azomethine based pigment and azo based pigment. Specific examples of the organic pigment are as follows.

Pigments used for the cyan ink may include C.I. pigment blue-1, 2, 3, 15, 15:1, 15:2, 15:3, 15:4, 15:6, 15:34, 16, 18, 22, 60, 65 and 66, and C.I. vat blue—4 and 60. Among these, any one of C.I. pigment blue—15:3 and 15:4 is preferable.

Pigments used for the magenta ink may include C.I. pigment red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48 (Ca), 48 (Mn), 57 (Ca), 57:1, 88, 112, 114, 122, 123, 144, 146, 149, 150, 166, 168, 170, 171, 175, 176, 177, 178, 179, 184, 185, 187, 202, 209, 219, 224, 245, 254 and 264, and C.I. pigment violet red 19, 23, 32, 33, 36, 38, 43 and 50. Among these, one or more types selected from C.I. pigment red 122, C.I. pigment red 202, and C.I. pigment violet red 19 is preferable.

Pigments used for the yellow ink may include C.I. pigment yellow—1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 155, 167, 172, 180, 185 and 213. Among these, one or more types selected from C.I. pigment yellow—74, 155, and 213 is preferable.

Further, pigments, used for the ink of colors such as green ink or orange ink other than the colors described above, may include those of the related art.

It is preferable that an average particle diameter of pigment is 250 or less nm so as to suppress the clogging in the internal portion of the nozzle 46 and further upgrade the discharge stability to become excellent. Further, the average particle diameter in the specification is based on the volume. As for a measurement method of the particles, it is possible to perform the measurement using, for example, a particle size distribution measuring apparatus based on a laser diffraction scattering method as the measurement principle. The particle size distribution measuring apparatus may include, for example, a particle size distribution meter based on a dynamic light scattering method as the measurement principle (for example, MICROTRACK UPA made by Nikkiso Co., Ltd.).

1-2. Dyes

It is possible to use a dye as the color material. Dyes are not particularly limited, but acid dyes, direct dyes, reactive dyes, and basic dyes may be used. The content amount of the color material is, preferably, 0.4 to 12 mass %, and further preferably, 2 or more and 5 or less mass %, with respect to the total mass (100 mass %) of the ink.

2. Resin

The ink contains resins. As the ink contains a resin, a resin coating can be formed on media. As a result, the ink is sufficiently fixed on the media, and abbreviation resistance of the main image is caused to effectively act. For this reason, it is preferable that resin emulsion is thermoplastic resin. The heat deformation temperature of the resin is preferably 40 or more ° C., more preferably, 60 or more ° C. because there is provided an advantageous effect in that it difficult to cause the nozzle the nozzle 46 to be clogged and the abbreviation resistance of the media is maintained.

Herein, "heat deformation temperature" in the specification corresponds to a temperature value expressed as a glass transition temperature (Tg) or a minimum film forming temperature (MFT). In other words, the expression "heat deformation temperature is 40 or more ° C." means that it is preferable that any one of Tg or MFT is 40 or more ° C. Since the MFT is superior in figuring out relative merits in re-dispersibility of a resin when compared with the case of the Tg, it is preferable that the heat deformation temperature is a temperature value expressed by the MFT. When re-dispersibility of a resin is excellent, it is difficult to clog the nozzle 46 because the ink is not fixed.

Specific examples of the thermoplastic resins described above are not particularly limited, but may include poly (meth) acrylic ester or copolymer thereof, polyacrylonitrile or copolymer thereof, (meth) acrylic based polymer such as polycyanoacrylate, polyacrylamide, and poly (meth) acrylic acid, polyethylene, polypropylene, polybutene, polyisobutylene, polystyrene, copolymer of polyethylene, polypropylene, polybutene, polyisobutylene and polystyrene, polyolefin based polymers such as oil resin, coumarone • indene resin and the terpene resin, polyvinyl acetate, copolymer of polyvinyl acetate, vinyl acetate based or vinyl alcohol based polymer such as polyvinyl alcohol, polyvinyl acetal and the polyvinyl ether, polyvinyl chloride or copolymer of polyvinyl chloride, halogen containing based polymer such as polyvinylidene chloride, fluoric resin and the fluorine rubber, polyvinylcarbazole, polyvinylpyrrolidone, copolymer of polyvinylcarbazole and polyvinylpyrrolidone, nitrogen containing vinyl based polymer such as polyvinyl pyridine and polyvinyl imidazole, polybutadiene, copolymer of polybutadiene, dience based polymer such as polychloroprene and polyisoprene (butyl), and other ring-opening polymerization type resin, polycondensation type resin and nature macromolecule resin.

The content amount of the resin is, preferably, 1 to 30 mass %, and more preferably, 1 to 5 mass %, with respect to the total mass (100 mass %) of the ink. In a case where the content amount is within the range described above, glossiness and abbreviation resistance of a formed finish-painted image can be further excellent. Further, the resin that may be contained in the ink may include, for example, a resin dispersant, a resin emulsion, a wax and the like.

2-1. Resin Emulsion

The ink may contain a resin emulsion. When media is heated, the resin emulsion forms a resin coating with, preferably, a wax (emulsion) so as to sufficiently fix the ink on the media and thus there can be provided an effect in that the abbreviation resistance of an image can be excellent. In a case where media is printed using the ink containing the emulsion, the ink is superior in the abbreviation resistance with respect to the ink non-absorbent or ink low-absorbent media.

Further, the resin emulsion functioning as a binder is contained as an emulsion in the ink. The resin functioning as a binder is contained in an emulsion state in the ink. Therefore, in the ink jet recording method, the viscosity of the ink can be easily adjusted, and thus it is possible to upgrade the preservation stability and the discharge stability of the ink to become excellent.

The resin emulsions are not limited to the below, but may include, for example, homopolymer or copolymer of (meth) acrylic acid, (meth) acrylic ester, acrylonitrile, cyanoacrylate, acrylic amide, olefin, styrene, vinyl acetate, vinyl chloride, vinyl alcohol, vinyl ether, vinyl pyrrolidone, vinyl pyridine, vinyl carbazole, vinyl imidazole and vinylidene chloride, fluoric resin and natural resin. Among these, one of meth acrylic based resin and styrene meth acrylic copolymer based resin is preferable, one of acrylic based resin and styrene-acrylic acid copolymer based resin is more preferable, and styrene-acrylic acid copolymer based resin is further more preferable. The copolymers described above may be any type of a random copolymer, a block copolymer, alternating copolymer and graft copolymer.

An average particle diameter of a resin emulsion is preferably in a range of 5 nm to 400 nm, and more preferably in a range of 20 nm to 300 nm so as to further upgrade the preservation stability and the discharge stability to become excellent. Among the resins, the content amount of the resin emulsion is, preferably, in a range of 0.5 to 7 mass % with respect to the total mass (100 mass %) of the ink. In a case where the content amount is within the range described above, it is possible to further upgrade the discharge stability to become excellent because a concentration of solid portion in the ink can be reduced.

2-2. Wax

The ink may contain wax. As the ink contains the wax, the ink is further superior in the fixability on the ink non-absorbent and ink low-absorbent media. Among the waxes, a wax of emulsion type is preferable. The waxes described above are not particularly limited, but may include, for example, polyethylene wax, paraffin wax and polyolefin wax. Among these, the polyethylene wax to be described later is preferable. Further, "wax" in the specification, generally means that a surfactant to be described later is used to disperse solid wax particles in water.

As the ink contains the polyethylene wax, it is possible to upgrade the abbreviation resistance of the ink. An average particle diameter of the polyethylene wax is preferably in a range of 5 nm to 400 nm, and more preferably in a range of 50 nm to 200 nm so as to further upgrade the preservation stability and the discharge stability to become excellent.

The content amount (in terms of solid portion) of the polyethylene wax is, preferably, in a range of 0.1 to 3 mass %, and more preferably, in a range of 0.3 to 3 mass %, further more preferably, in a range of 0.3 to 1.5 mass %, independently, with respect to the total mass (100 mass %) of the ink. In a case where the content amount is within the range described above, it is possible to excellently solidify • fix the ink even on the ink non-absorbent or ink low absorbent media and also to further upgrade the preservation stability and the discharge stability to become excellent.

3. Surfactant

The ink may contain a surfactant. The resin emulsions are not limited to the below, but may include, for example, a nonionic surfactant. The nonionic surfactant causes the ink to evenly spread on media. For this reason, in a case where the ink containing the nonionic surfactant is used to perform the printing, it is possible to obtain a high precision image without ink running. Such a nonionic is not limited to the below, but may include, for example, silicon based, polyoxyethylene alkyl ether based, polyoxypropylene alkyl ether based, polycyclic phenyl ether based, sorbitan derivative and fluorine-based surfactants. Among these, silicon based surfactant is preferable.

The content amount of the surfactant is, preferably, in a range of 0.1 or more to 3 or less mass %, with respect to the total mass (100 mass %) of the ink, so as to further upgrade the preservation stability and the discharge stability to become excellent.

4. Organic Solvent

The ink may contain a well-known volatile water-soluble organic solvent. As described above, however, the ink does not substantially contain glycerin that is a kind of an organic solvent (having a boiling point of 290° C. under 1 atmosphere). Further, it is preferable that the ink substantially does not contain alkylpolyol group (except for the glycerin described above) having a boiling point of 280° C. or more under 1 atmosphere or the equivalent thereof.

5. Non-Proton Type Polar Solvent

The ink may contain a non-proton type polar solvent. As the ink contains the non-proton type polar solvent, the above resin particles contained in the ink is dissolved, and thus it is possible to effectively suppress the clogging of the nozzle 46 during printing. Further, the non-proton type polar solvent has a property for dissolving media such as vinyl chloride so that adhesion of an image can be improved.

The non-proton type polar solvent is not particularly limited, but may include one or more kinds selected from pyrrolidones, lactones, sulfoxides, imidazolidinones, sulfolanes, urea derivatives, dialkyl amides, cyclic ethers, and amide ethers. Typical examples of the pyrrolidones may include 2-pyrrolidone, N-methyl-2-pyrrolidone, and N-ethyl-2-pyrrolidone. Typical examples of the lactones may include γ-butyrolactone, γ-valerolactone, and ε-caprolactone. Typical examples of sulfoxides may include dimethyl sulfoxide, and tetramethylene sulfoxide.

Typical examples of the imidazolidinones may include 1,3-dimethyl-2-imidazolidinones, typical examples of the sulfolanes may include sulfolane and dimethyl sulfolane, typical examples of the urea derivatives may include dimethylurea, 1,1,3,3-tetramethyl ureas, typical examples of the dialkyl amides may include dimethylformamide and dimethyl acetamide, and typical examples of cyclic ethers may include 1,4-dioxane and tetrahydrofuran.

Among these, in view of the effects described above, particularly, the pyrrolidones, the lactones, the sulfoxides and the amide ethers are, preferable, and the 2-pyrrolidones are most preferable. The content amount of the non-proton type polar solvent is, preferably, in a range of 3 to 30 mass %, and more preferably, in a range of 8 to 20 mass % with respect to the total mass (100 mass %) of the ink.

6. Other Components

In addition to the components described above the ink may an antifungal agent, a rust-preventive agent, a chelating agent and the like.

The entire disclosure of Japanese Patent Application No. 2014-140375, filed Jul. 8, 2014 and No. 2014-142945, filed Jul. 11, 2014 are expressly incorporated by reference herein.

What is claimed is:

1. A maintenance method of a liquid ejecting apparatus which includes a liquid ejecting portion configured to eject a first liquid from an opening of a nozzle disposed in a nozzle forming surface; and a fluid ejecting apparatus configured to eject at least one of a gas and a second liquid toward the nozzle forming surface in a state where a space including the nozzle forming surface is covered with air, the fluid ejecting apparatus including a fluid ejecting nozzle configured to move in a moving direction along the nozzle forming surface at an ejecting position facing the nozzle forming surface of the liquid ejecting portion, the fluid ejecting nozzle at the ejecting position being disposed lower than the nozzle of the liquid ejecting portion in a gravity direction, and the fluid ejecting nozzle having a liquid ejecting opening through which the second liquid is ejected and a gas ejecting opening through which the gas is ejected, a liquid accommodating portion configured to accommodate the second liquid, a liquid flow path through which the second liquid accommodated in the liquid accommodating portion flow toward the liquid ejecting opening, and a gas flow path through which the gas flow toward the gas ejecting opening, the maintenance method comprising:

generating a mixed fluid in which the second liquid of droplet-like shape and the gas are mixed by ejecting the gas from the gas ejecting opening in a flowable state where the second liquid in the liquid accommodating portion is flowable into the liquid flow path; and ejecting the second liquid from the fluid ejecting nozzle by pumping the second liquid in the liquid flow path toward the liquid ejecting opening, wherein a pressure applied to the second liquid in the liquid flow path when ejecting the second liquid is higher than a pressure applied to the second liquid in the liquid flow path when generating the mixed fluid.

2. The maintenance method of a liquid ejecting apparatus according to claim 1, wherein the fluid ejecting nozzle configured to move between the ejecting position and a standby position, the maintenance method further comprising after moving the fluid ejecting nozzle from the standby position to ejecting position, ejecting the mixed fluid toward the nozzle forming surface in the state.

3. The maintenance method of a liquid ejecting apparatus according to claim 2, wherein in the flowable state, an air-liquid interface of the second liquid is located at a position lower than the liquid ejecting opening and the gas ejecting opening.

4. The maintenance method of a liquid ejecting apparatus according to claim 3, further comprising after the ejection of the mixed fluid toward the nozzle forming surface, discharging the first liquid from the opening of the nozzle.

5. The maintenance method of a liquid ejecting apparatus according to claim 4, further comprising after the ejection of the mixed fluid toward the nozzle forming surface, wiping the nozzle forming surface.

6. The maintenance method of a liquid ejecting apparatus according to claim 5, wherein the ejection of the second liquid is performed before the ejection of the mixed fluid.

7. The maintenance method of a liquid ejecting apparatus according to claim 6, wherein the liquid accommodating portion includes a liquid accommodating space which accommodates the second liquid, and in the flowable state, the liquid accommodating space communicates with the atmosphere.

8. The maintenance method of a liquid ejecting apparatus according to claim 7, further comprising:

ejecting the gas from the fluid ejecting nozzle at the standby position.

9. The maintenance method of a liquid ejecting apparatus according to claim 8, wherein the ejection of the gas is performed after the ejection of the second liquid.

* * * * *